US010710784B2

(12) United States Patent
Brooks

(10) Patent No.: US 10,710,784 B2
(45) Date of Patent: Jul. 14, 2020

(54) FOLDABLE SPOON AND METHOD FOR MAKING

(71) Applicant: Matthew Brooks, Santa Cruz, CA (US)

(72) Inventor: Matthew Brooks, Santa Cruz, CA (US)

( * ) Notice: Subject to any disclaimer, the term of this patent is extended or adjusted under 35 U.S.C. 154(b) by 0 days.

(21) Appl. No.: 13/779,426

(22) Filed: Feb. 27, 2013

(65) Prior Publication Data

US 2014/0238987 A1 Aug. 28, 2014

(51) Int. Cl.

| | |
|---|---|
| ***A47G 21/04*** | (2006.01) |
| ***B65D 51/24*** | (2006.01) |
| ***B31D 5/04*** | (2017.01) |
| ***B65D 77/24*** | (2006.01) |
| *A47G 21/00* | (2006.01) |

(52) U.S. Cl.
CPC ..... *B65D 51/246* (2013.01); *A47G 21/04* (2013.01); *B31D 5/04* (2013.01); *B65D 77/245* (2013.01); *A47G 2021/002* (2013.01)

(58) Field of Classification Search
CPC ..... A47G 21/04
USPC ..... 30/324–328
See application file for complete search history.

(56) References Cited

U.S. PATENT DOCUMENTS 652,350 A * 6/1900 Davenport ..... 294/180
1,521,768 A * 1/1925 Herrmann ..... A47G 21/04 30/328
2,375,266 A * 5/1945 Wilson ..... 229/404
2,453,393 A * 11/1948 Wilson ..... A47G 21/04 215/228
3,222,785 A * 12/1965 Bastis ..... B26B 9/02 30/348
3,828,999 A * 8/1974 Humphrey ..... A47G 21/04 229/401
4,060,176 A * 11/1977 Tobiasson ..... A47G 21/04 206/217
5,884,837 A * 3/1999 Jacobsson ..... B65D 77/40 229/204
6,163,991 A * 12/2000 Drapcho ..... G09F 11/00 283/117
6,371,324 B1 * 4/2002 Torniainen et al. ..... 220/212
7,311,526 B2 * 12/2007 Rohrbach ..... H01R 13/6205 439/218
2005/0199635 A1 * 9/2005 Chang ..... A47G 19/06 220/574
2007/0084064 A1 * 4/2007 Fite, IV ..... A47G 19/02 30/324
2008/0099476 A1 * 5/2008 Fung ..... A47J 36/02 220/6
2010/0288826 A1 * 11/2010 Yaloz et al. ..... 229/401

* cited by examiner

*Primary Examiner* — Kenneth E Peterson
*Assistant Examiner* — Liang Dong
(74) *Attorney, Agent, or Firm* — John R. Ross; John R. Ross, III

(57) ABSTRACT

A foldable spoon. A spoon handle includes apex folds and valley folds that are used to create a strong spoon handle. A spoon cup section is connected to the spoon handle. The spoon apex folds, spoon valley folds and spoon cup section are preferably formed from a single sheet of foldable material.

1 Claim, 35 Drawing Sheets

FOLDABLE SPOON AND METHOD FOR MAKING

The present invention relates to eating utensils, and in particular, to folding spoons. This application is a Continuation-in-Part (CIP) of U.S. patent application Ser. No. 13/401,673 filed Feb. 21, 2012, which claims the benefit of Provisional Application 61/444,745, filed on Feb. 20, 2011, both of which are incorporated by reference herein.

BACKGROUND OF THE INVENTION

Paper

Paper is a thin material mainly used for writing upon, printing upon or for packaging. It is produced by pressing together moist fibers, typically cellulose pulp derived from wood, rags or grasses, and drying them into flexible sheets.

Cardboard

Cardboard is a generic term for a heavy-duty paper. It may refer to: binder's board, card stock (heavy paper used for making cards), corrugated fiberboard (a combination of paperboards, usually two flat liners and one inner fluted corrugated medium, often used for making corrugated boxes), display board, poster board, paperboard, (a paper-based material often used for folding cartons, set-up boxes, carded packaging, etc.), containerboard, folding boxboard, solid bleached board, solid unbleached board, or white lined chipboard.

Paperboard

Paperboard is a thick paper based material. While there is no rigid differentiation between paper and paperboard, paperboard is generally thicker (usually over 0.25 mm/0.010 in or 10 points) than paper. According to ISO standards, paperboard is a paper with a basis weight (grammage) above 224 g/m$^2$, but there are exceptions. Paperboard can be single or multi-ply. Paperboard used for the manufacture of folding cartons and rigid set-up boxes is often called boxboard. Paperboards used for the manufacture of corrugated fiberboard are called containerboard. It can be easily cut and formed, is lightweight, and because it's strong, it's used in packaging. Another end-use would be graphic printing, such as book and magazine covers or postcards. Sometimes it is referred to as cardboard, which is a generic, lay term used to refer to any heavy paper pulp based board.

Within the packaging industry, the generic term is more often pasteboard, and specific kinds are referred to by their initials or a shorthand. The most common types used for retail packaging are SB (solid bleach), CCKB (clay-coated kraft back) and CCNB (clay-coated news back).

Card Stock

Card stock, also called cover stock or pasteboard, is a paper stock that is thicker and more durable than normal writing or printing paper, but thinner and more flexible than other forms of paperboard. Card stock is often used for business cards, postcards, playing cards, catalog covers, scrapbooking, and other uses which require higher durability than regular paper. The texture is usually smooth, but can be textured, metallic, or glossy.

Card stock thickness is often described by pound weight. Pound weight is the weight of 500 sheets of 20 by 26 in (508 by 660 mm) paper. This differs from how text stock is determined, which assumes 500 sheets of 25 by 38 in (635 by 965 mm) paper. Most countries use the term grammage to describe the weight of the paper in grams per square meter. The term card stock is used to describe paper with weights from 50 lb to 110 lb (about 135 to 300 g/m$^2$).

In the U.S., card stock thickness is usually measured in points or mils that gives the thickness of the sheet in thousandths of an inch. For example, a 10 pt. card is 0.010 in (0.254 mm) thick (roughly corresponding to a weight of 250 g/m$^2$); 12 pt. is 0.012 in (0.3048 mm).

Origami

Origami from ori meaning "folding", and kami meaning "paper") is the traditional Japanese folk art of paper folding, which started in the 17th century AD and was popularized in the mid-1900s. It has since then evolved into a modern art form. The goal of this art is to transform a flat sheet of material into a finished sculpture through folding and sculpting techniques, and as such the use of cuts or glue are not considered to be origami.

Disposable Spoons

Currently a consumer may purchase a disposable spoon. Common disposable spoons are plastic spoons ideal for picnics and very casual eating affairs. However, the prior art spoons are not ideal for all situations.

What is needed is a better folding spoon.

SUMMARY OF THE INVENTION

The present invention provides a foldable spoon. A spoon handle includes apex folds and valley folds that are used to create a strong spoon handle. A spoon cup section is connected to the spoon handle. The spoon apex folds, spoon valley folds and spoon cup section are preferably formed from a single sheet of foldable material.

BRIEF DESCRIPTION OF THE PREFERRED EMBODIMENTS

DETAILED DESCRIPTION OF THE PREFERRED EMBODIMENTS

The present invention provides a folding spoon that can be economically packaged with a food product and then utilized for eating food.

Preferred Methods for Folding

Figure 1:
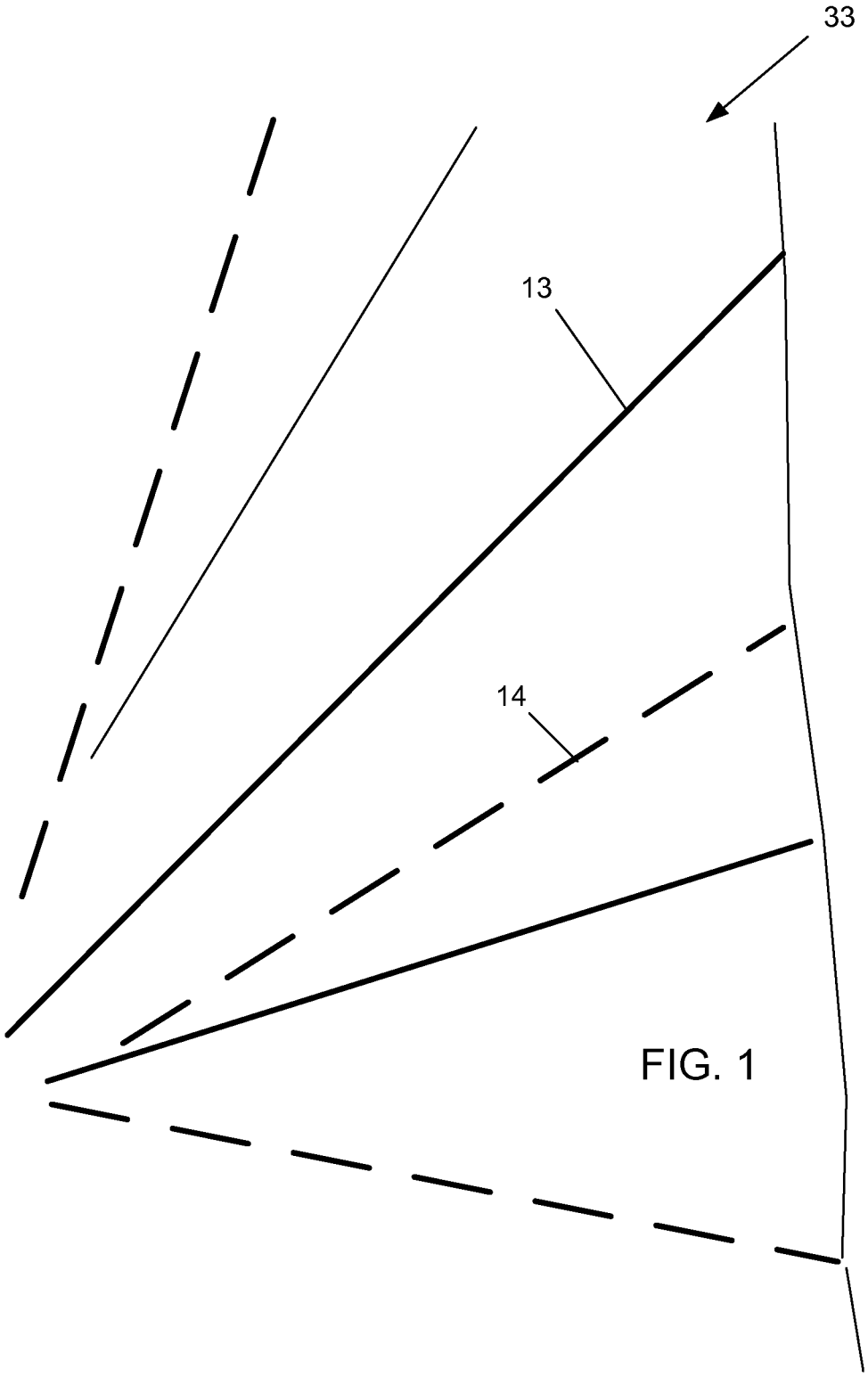
FIGS. 1-6 show a preferred embodiment of the present invention.
Figure 2:
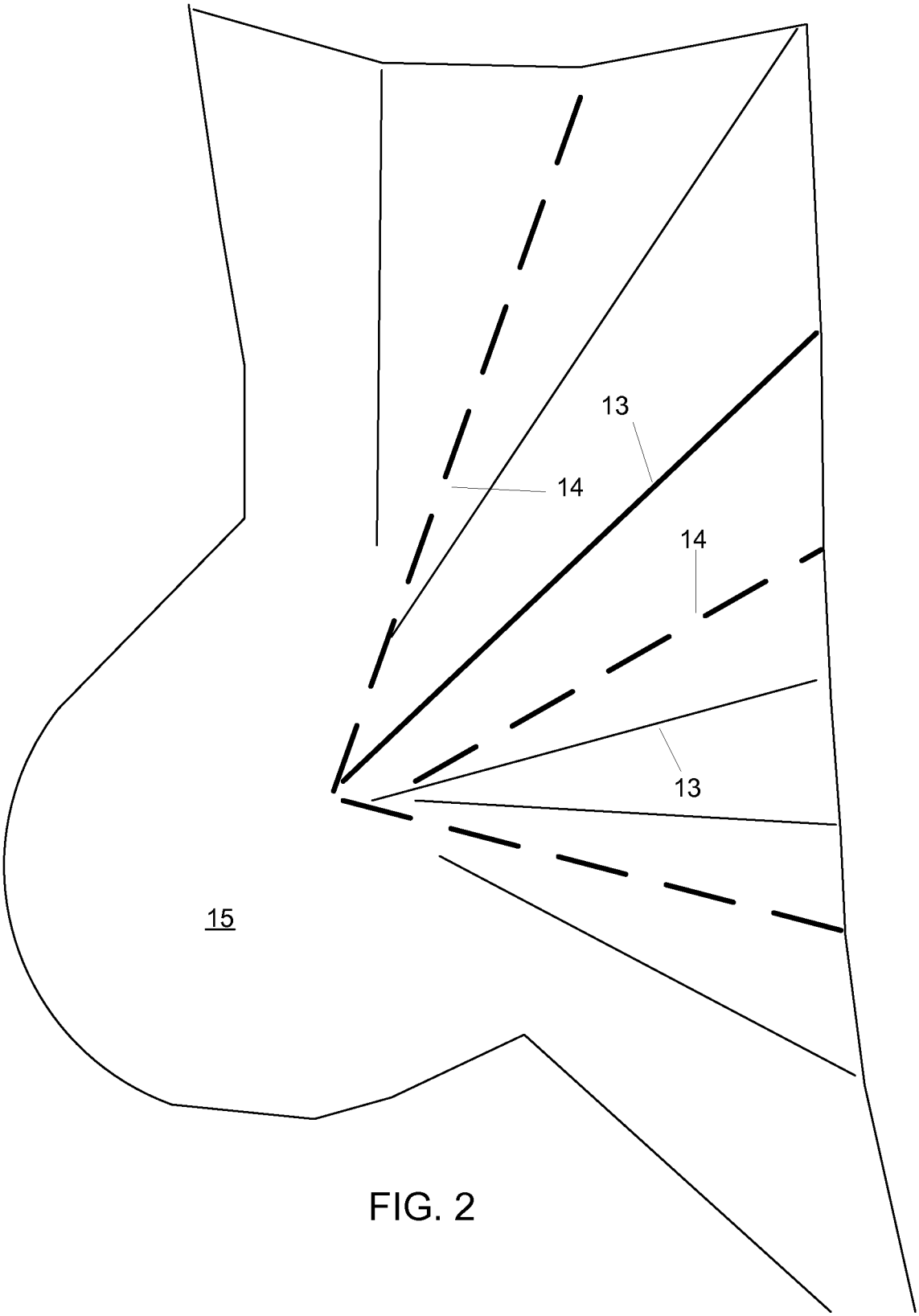
Figure 3:
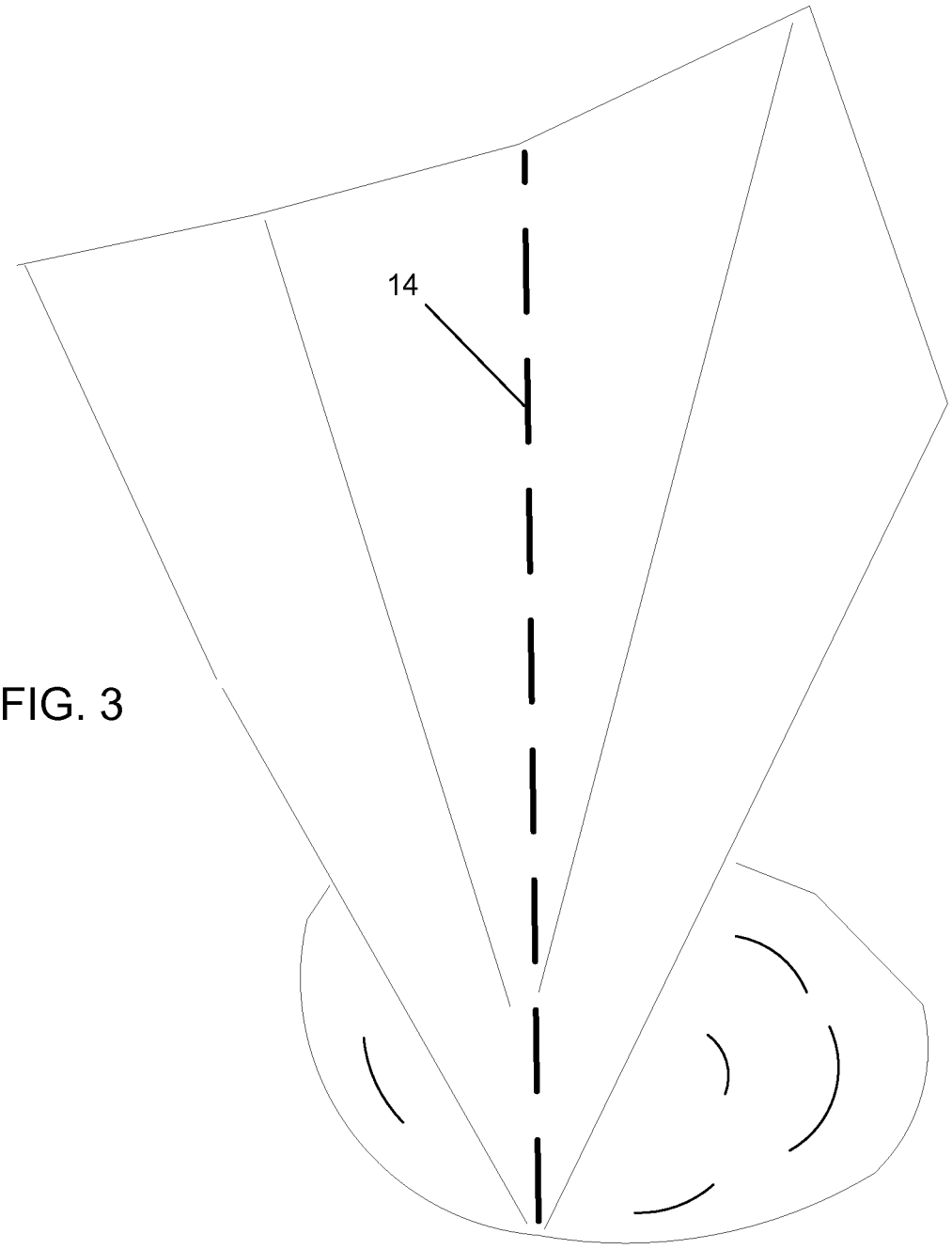
Figure 4:
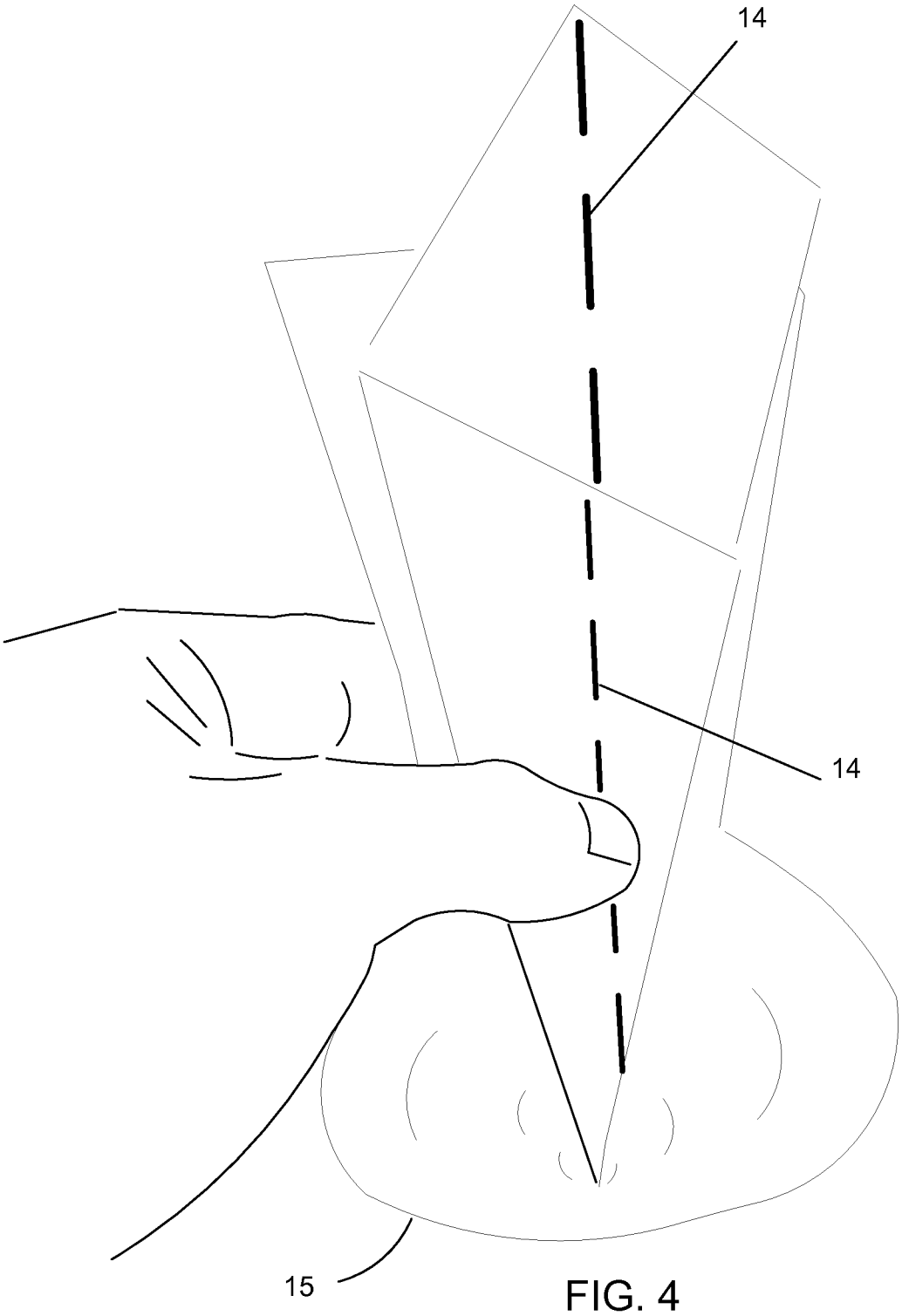
Figure 5:
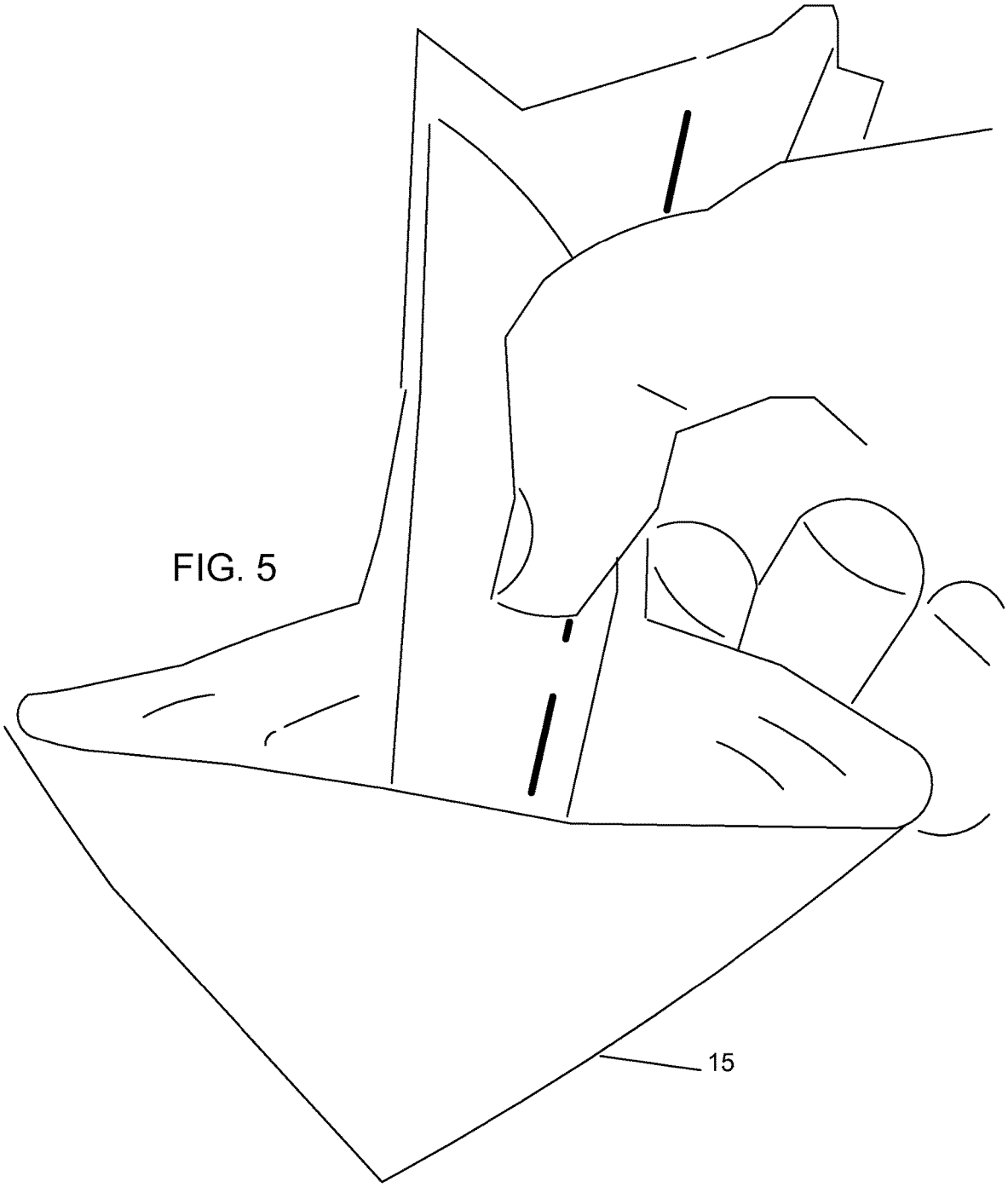
Figure 7:
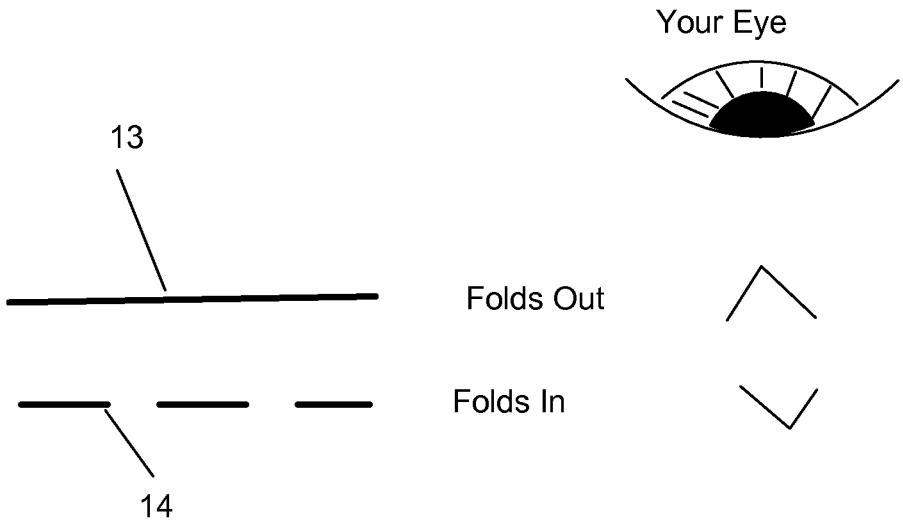
FIG. 7 shows a preferred key.

FIG. 1 shows sheet of paper 33. Paper 33 has been marked with solid lines 13 and dotted lines 14. Solid lines 13 represent apexes for folding outward and dotted lines 14 represent valleys for folding inward. Lines 13 and 14 are also shown in FIG. 7.

Basic Fold

Prior to folding the paper, the user chooses where to place the apex of the fold. Preferably, apex 622 may be placed at any point along vertical line 620 that extends the full length of the sheet of paper and is halfway across the sheet of paper. For example, FIGS. 39A-39E show some of the alternate positions of apex 622.

Figure 39:
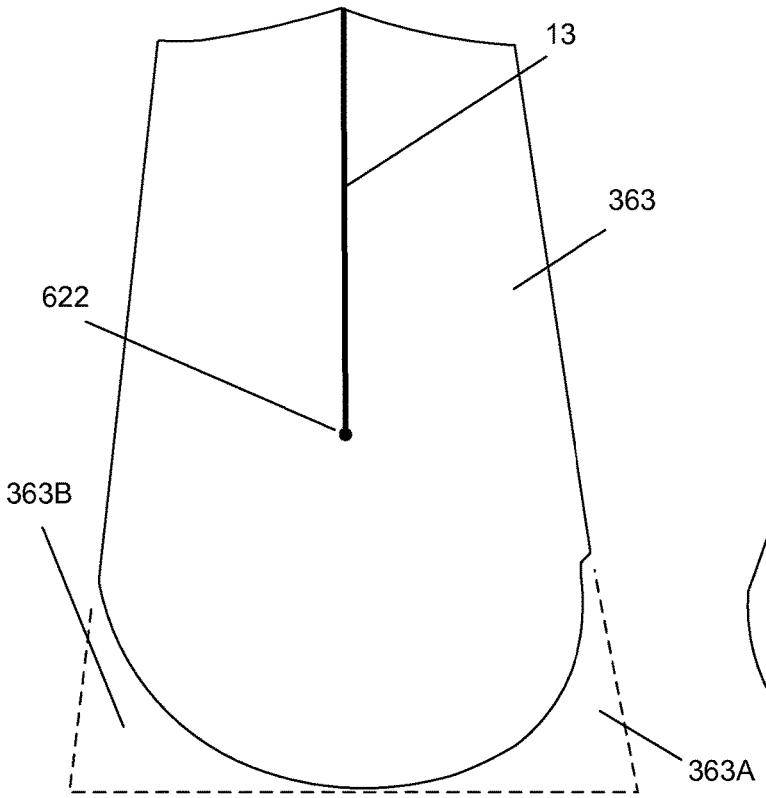
FIGS. 39-41 show another preferred embodiment of the present invention.
Figure 40:
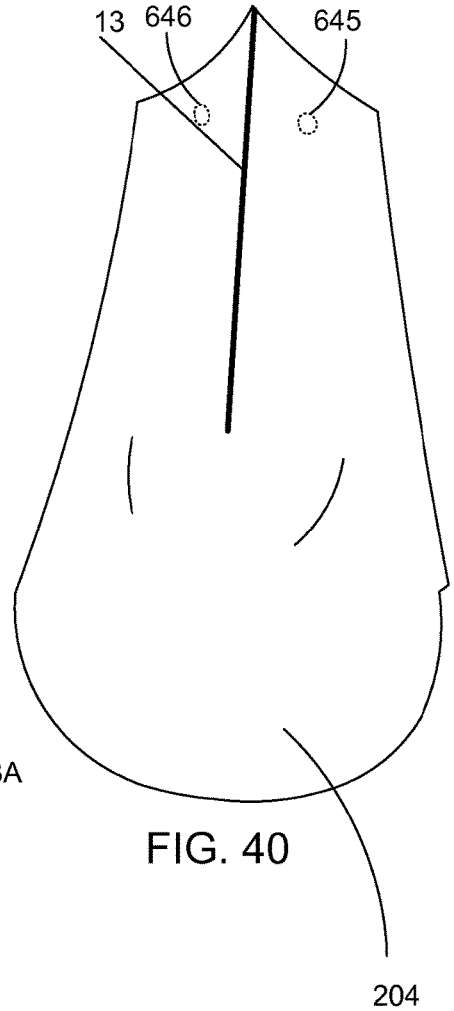
Figure 41:
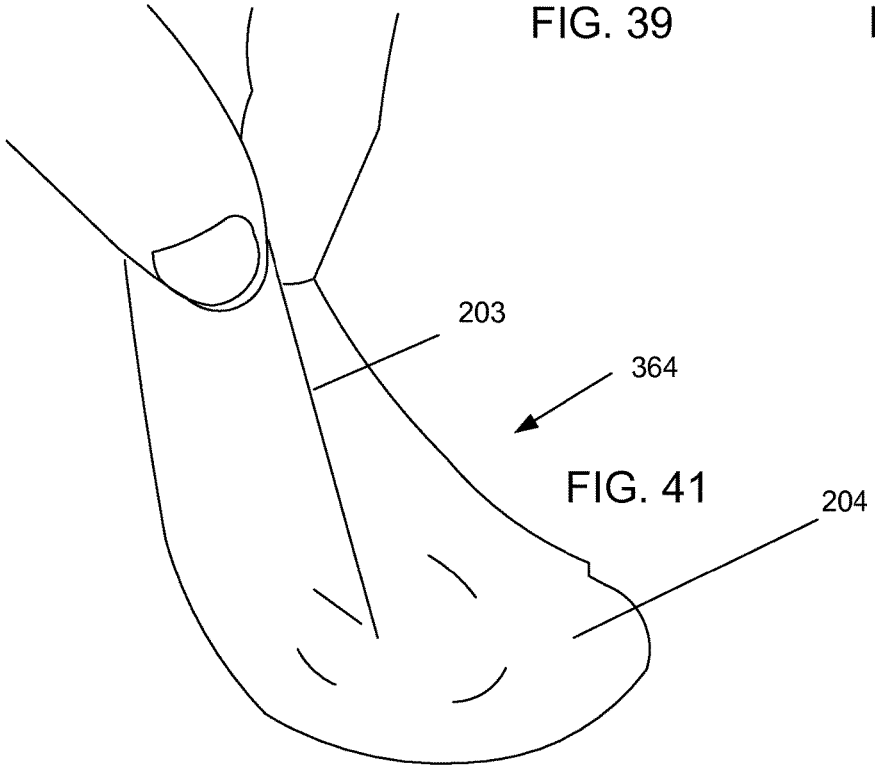

An example of a basic fold is shown in FIGS. 39-41. Corners 363A and 363B have been cut away from sheet 363. Sheet 363 includes apex fold 13 that extends over half way down the sheet of paper. Apex 622 is positioned at the end of fold 13 approximately halfway down the sheet of paper.

In FIG. 40, the user has squeezed the upper end of the paper together at points 645 and 646. This has caused cup portion 204 to begin formation as shown.

In FIG. 41, the user has finished squeezing the upper portion of the paper and now has a handle so that he can hold the spoon. Cup portion 204 has been formed and is capable of holding a variety of material. For example, cup portion 204 can hold water, ice cream, cereal or soup.

Figure 39A:
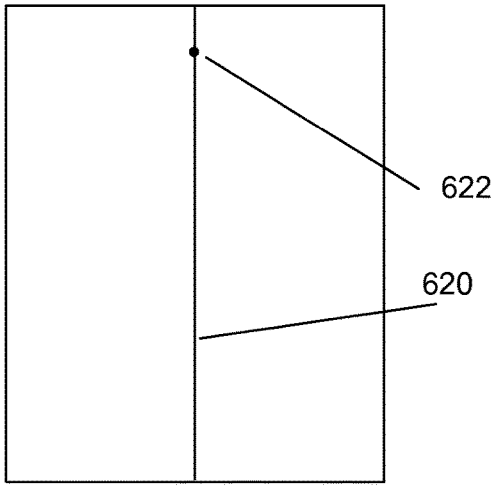
Figure 39B:
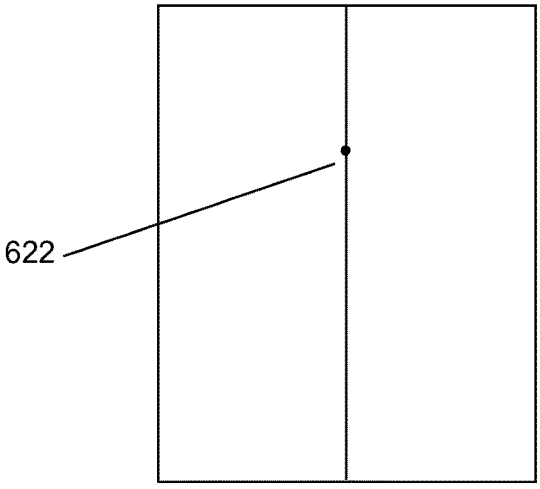
Figure 39C:
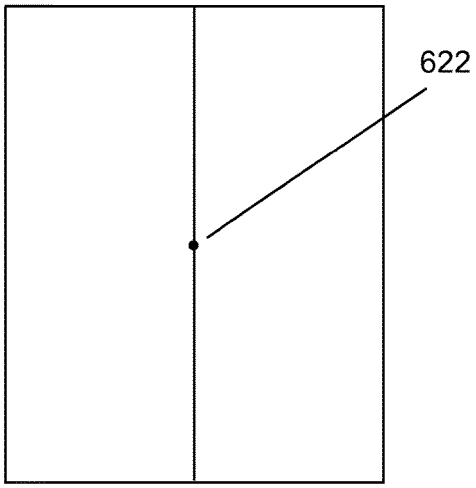
Figure 39D:
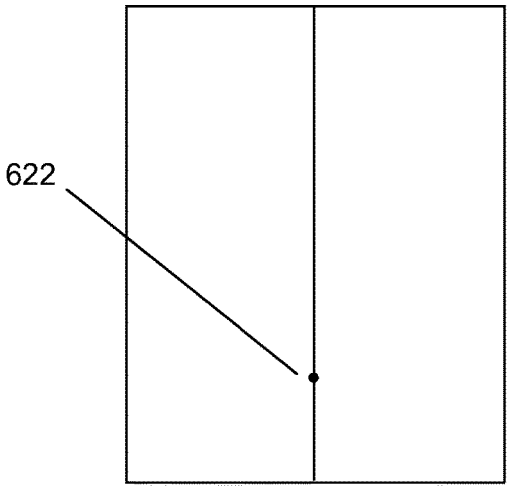
Figure 39E:
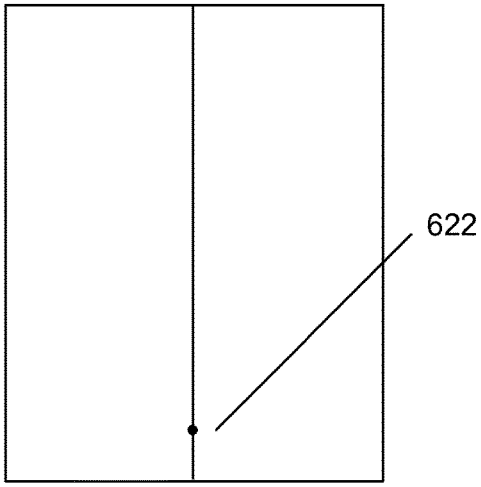
Figure 39F:
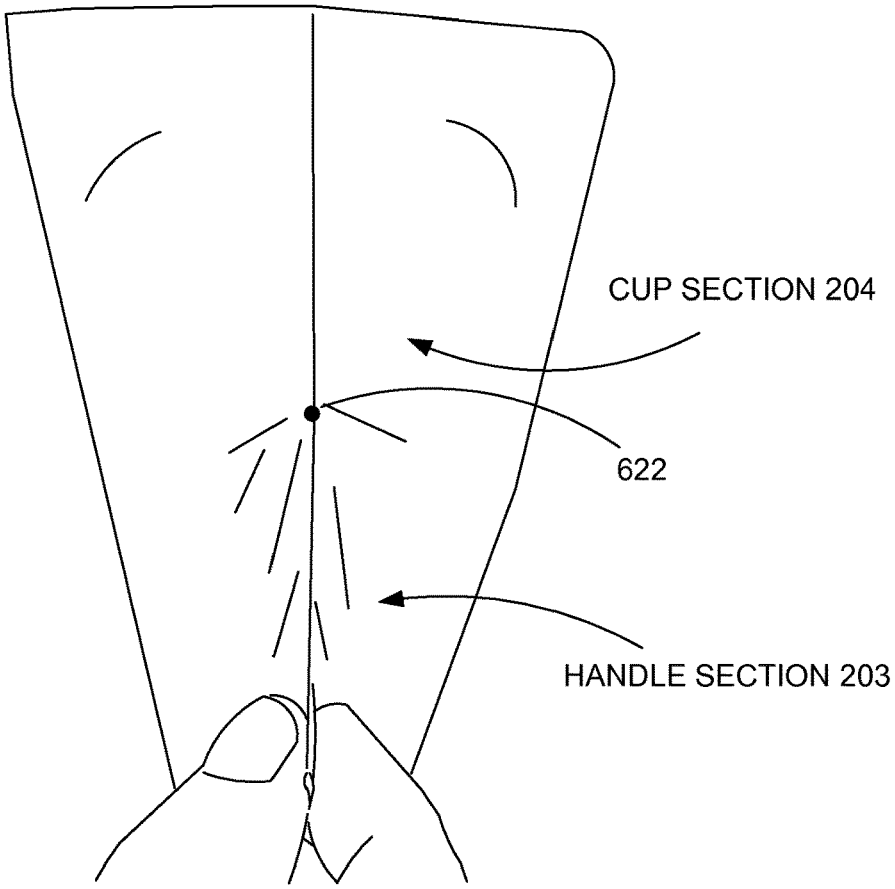
Figure 39G:
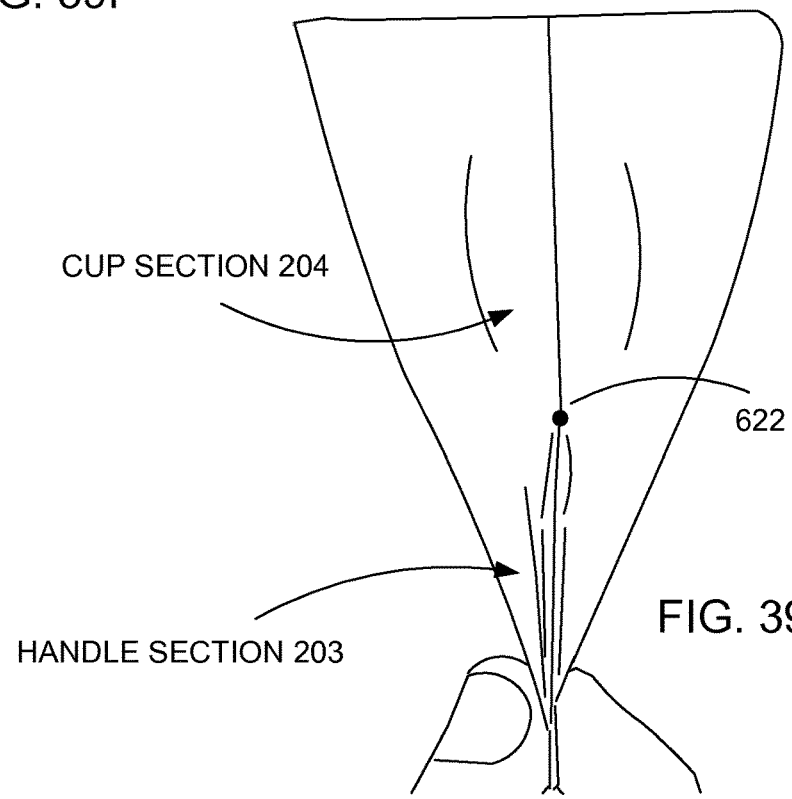

FIGS. 39F and 39G show detailed views of the formation of cup portion 204 and handle section 203.

The following embodiments will show modifications and additions to the basic fold.

Examples of Folded Utensils

Figure 8:
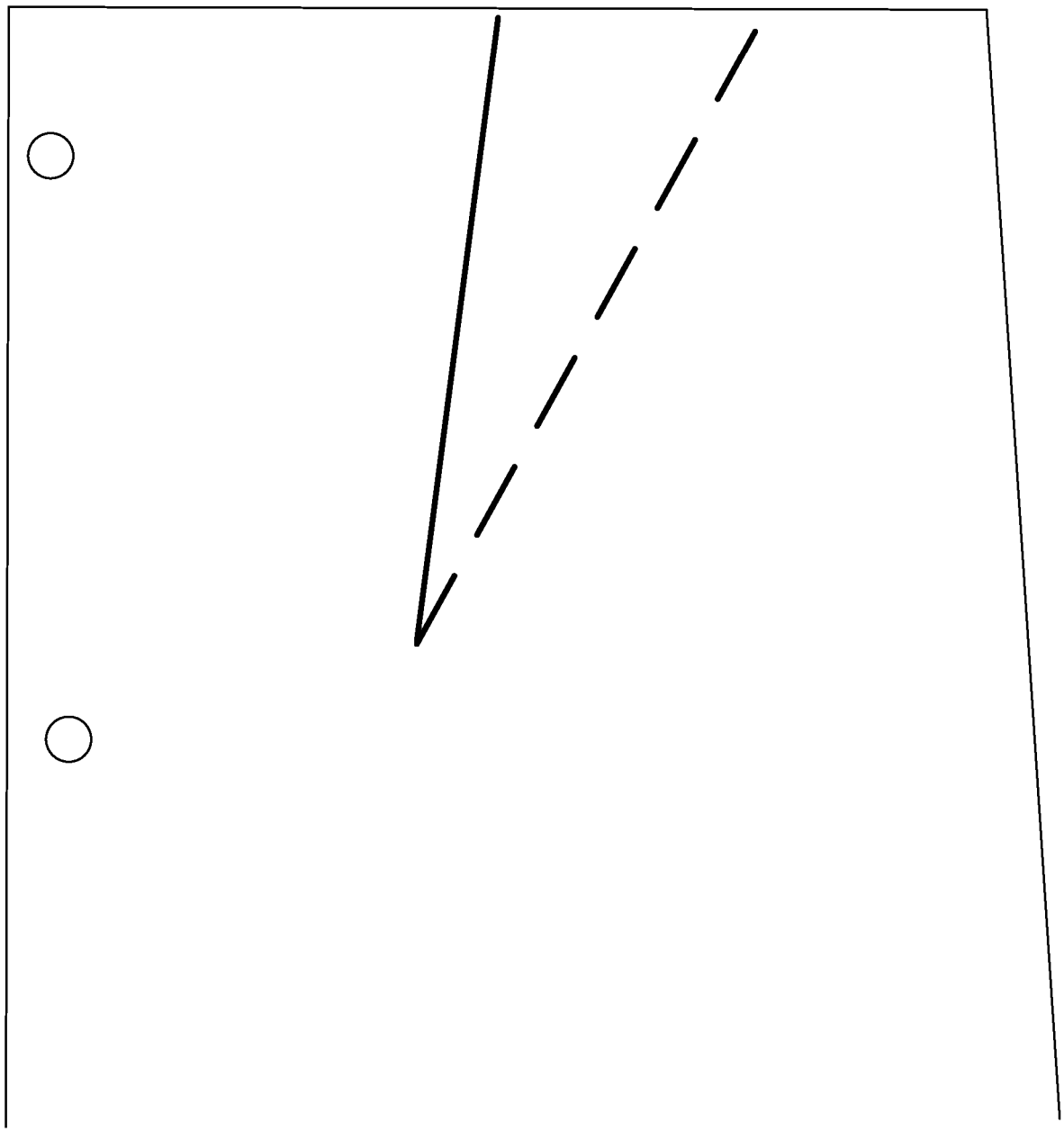
FIGS. 8-10 show another preferred embodiment of the present invention.
Figure 9:
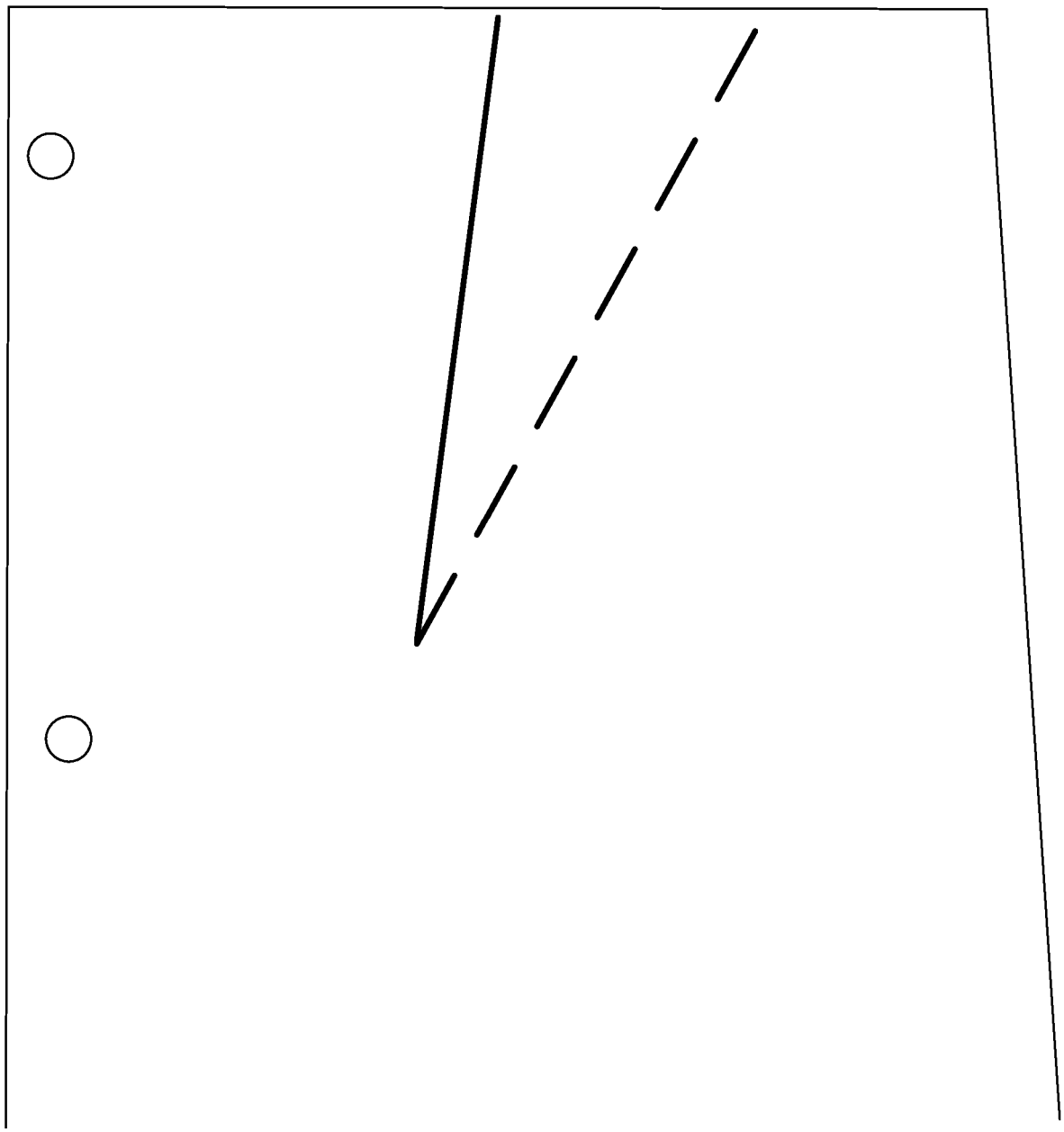
Figure 10:
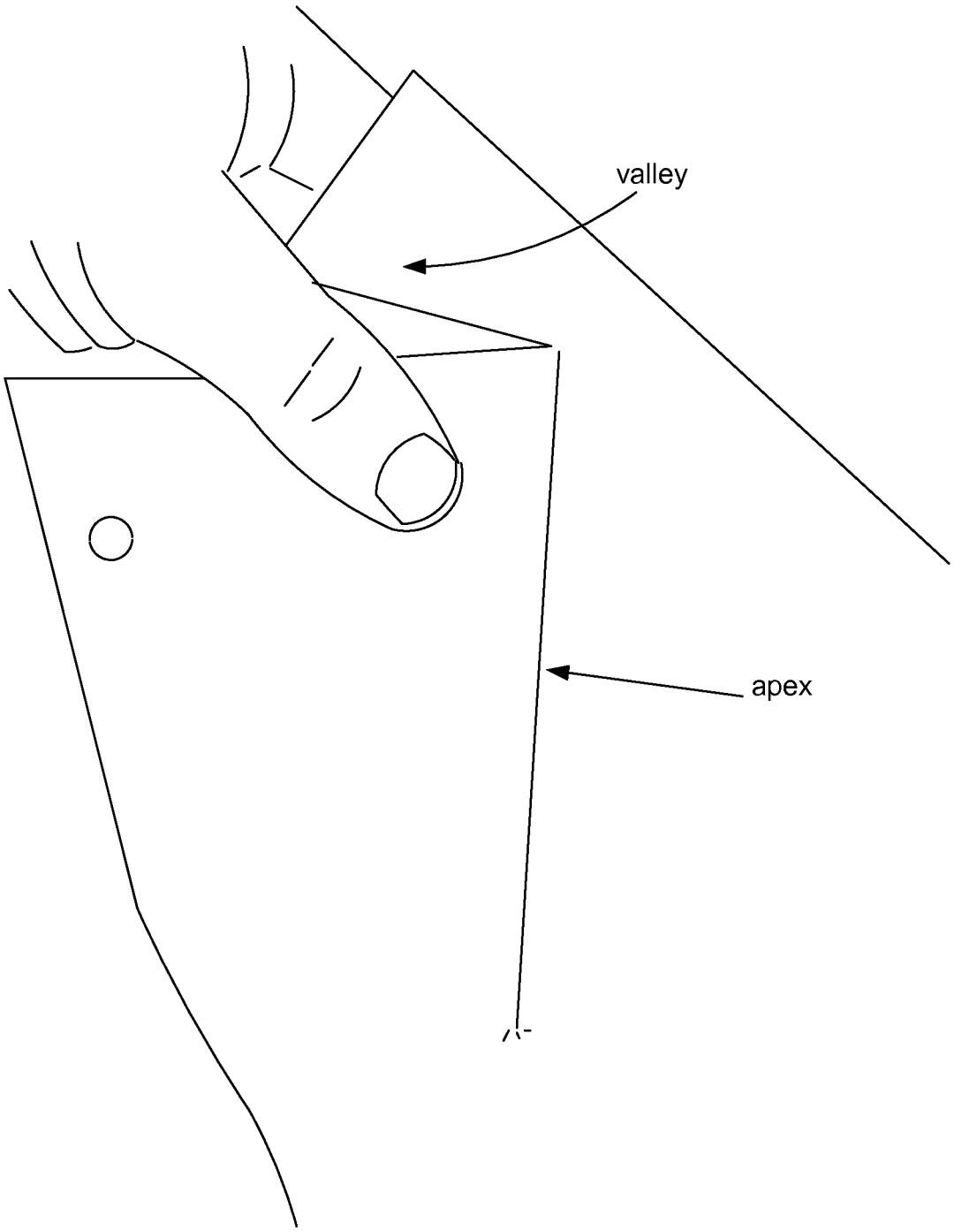
Figure 11:
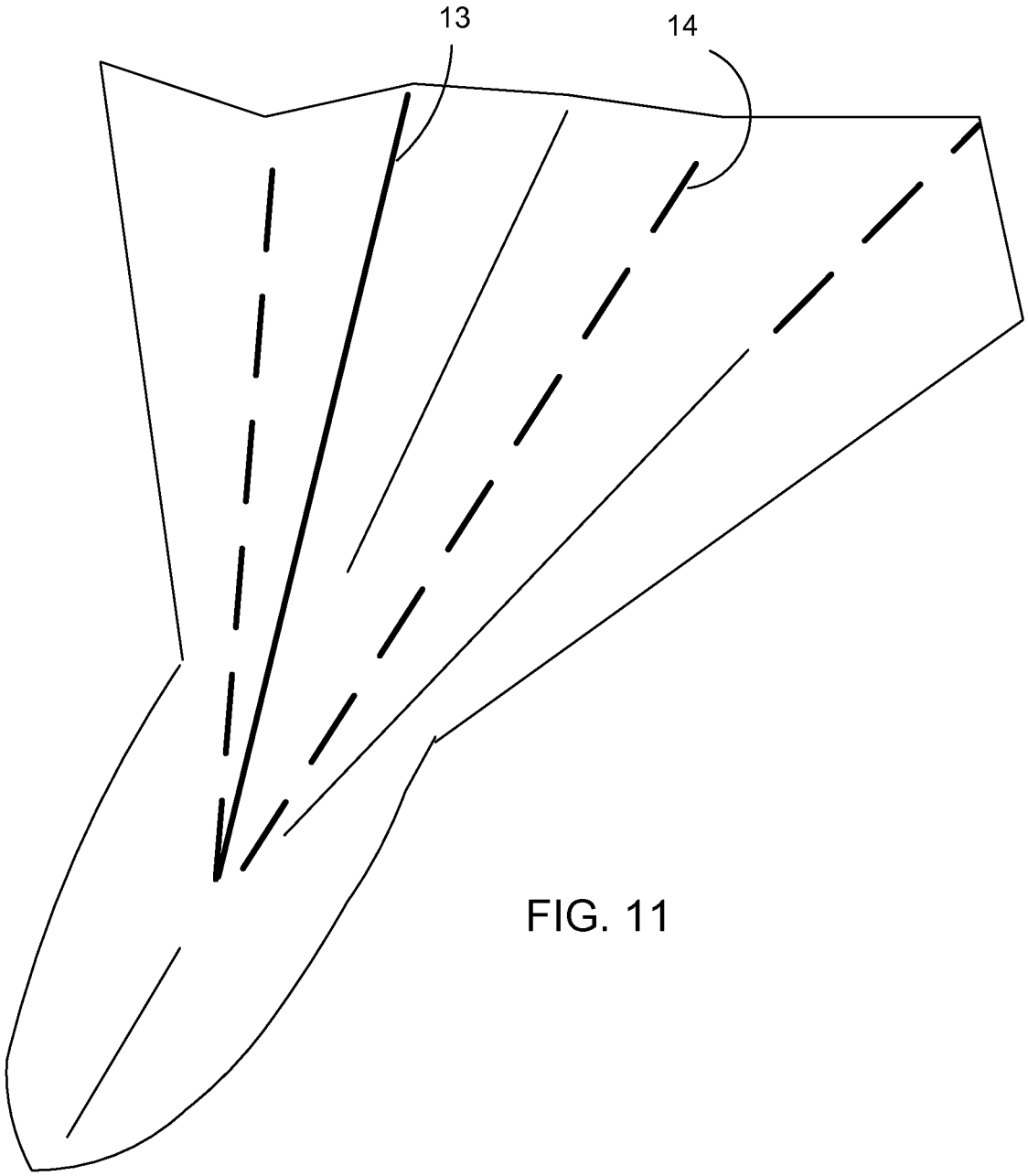
FIGS. 11-18 show another preferred embodiment of the present invention.
Figure 12:
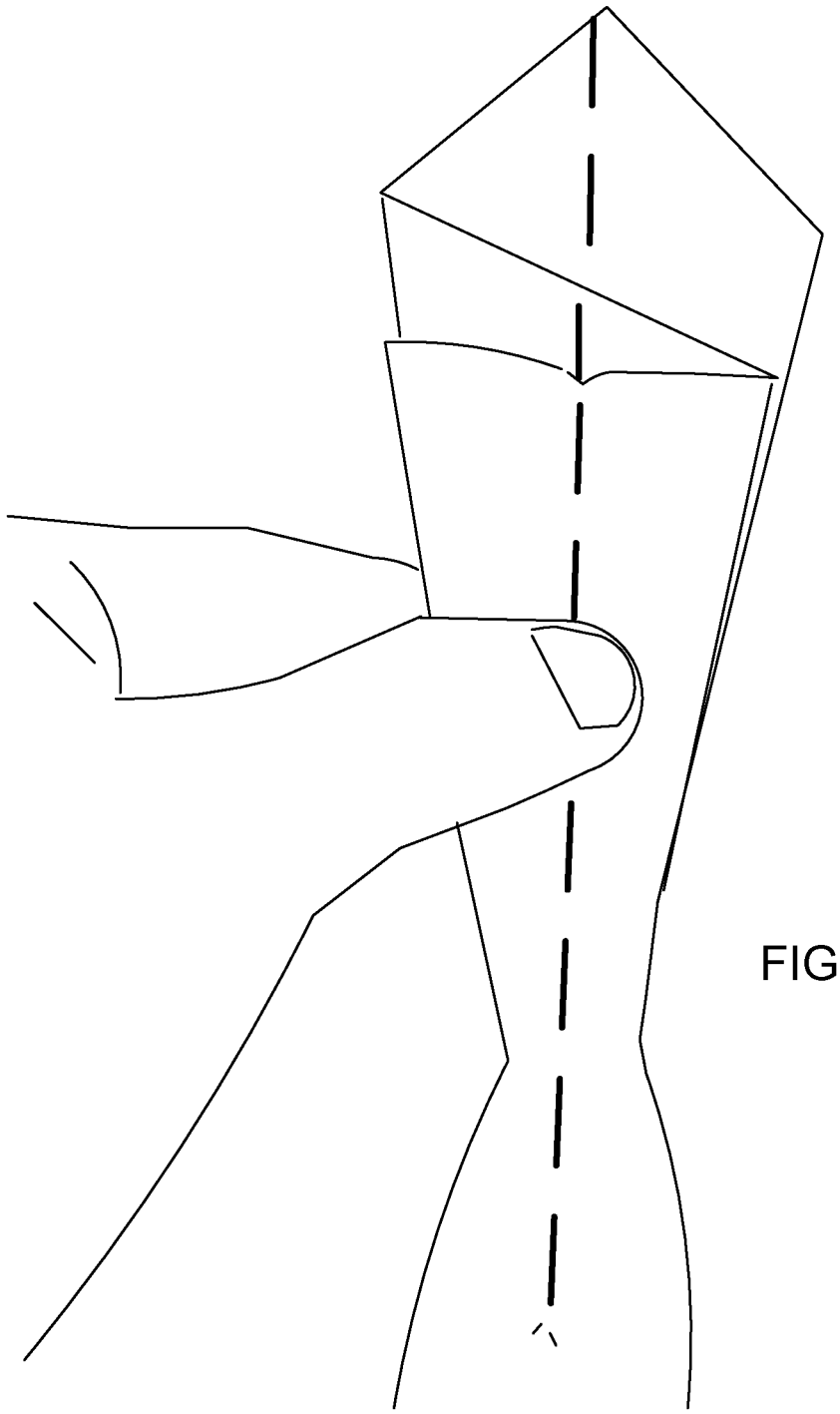
Figure 13:
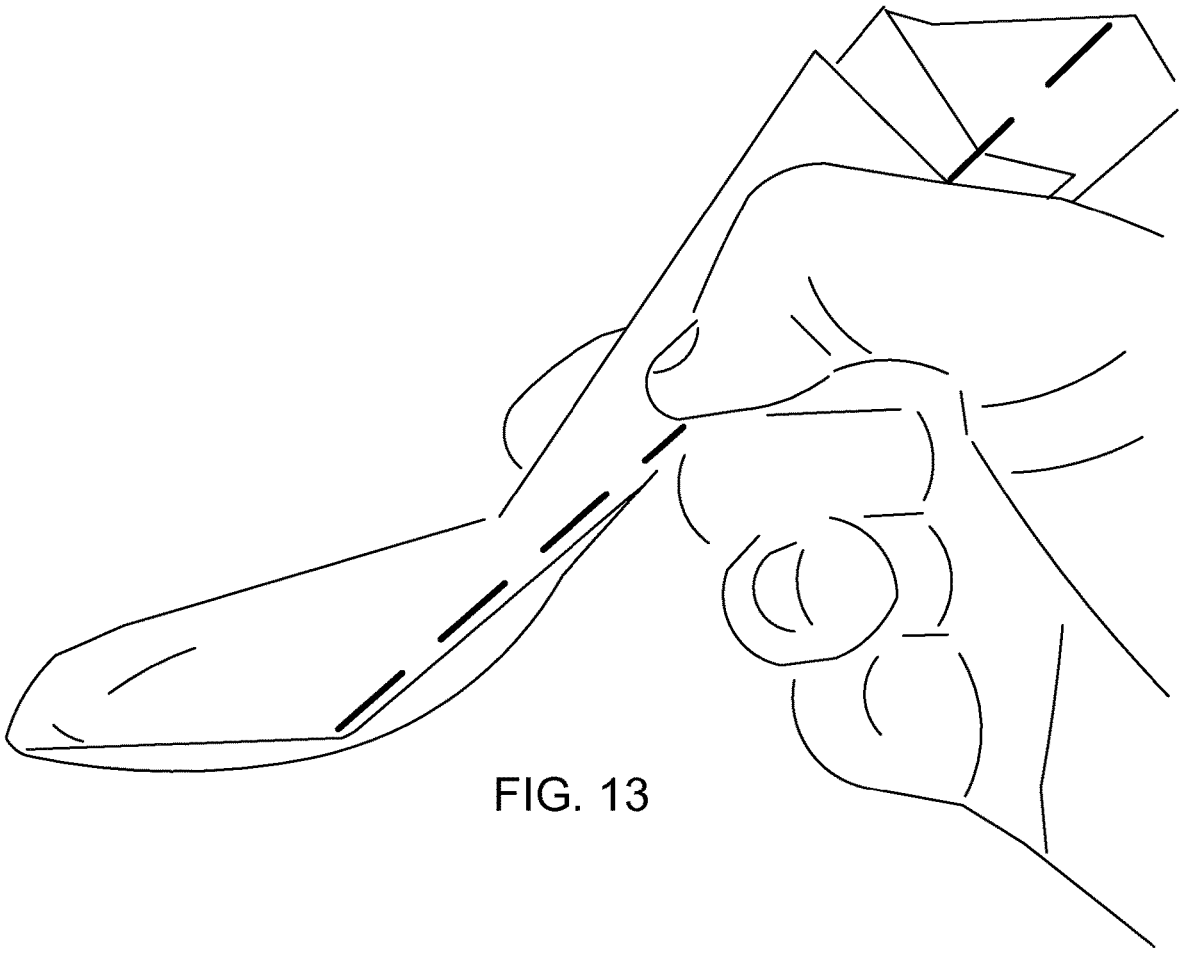
Figure 14:
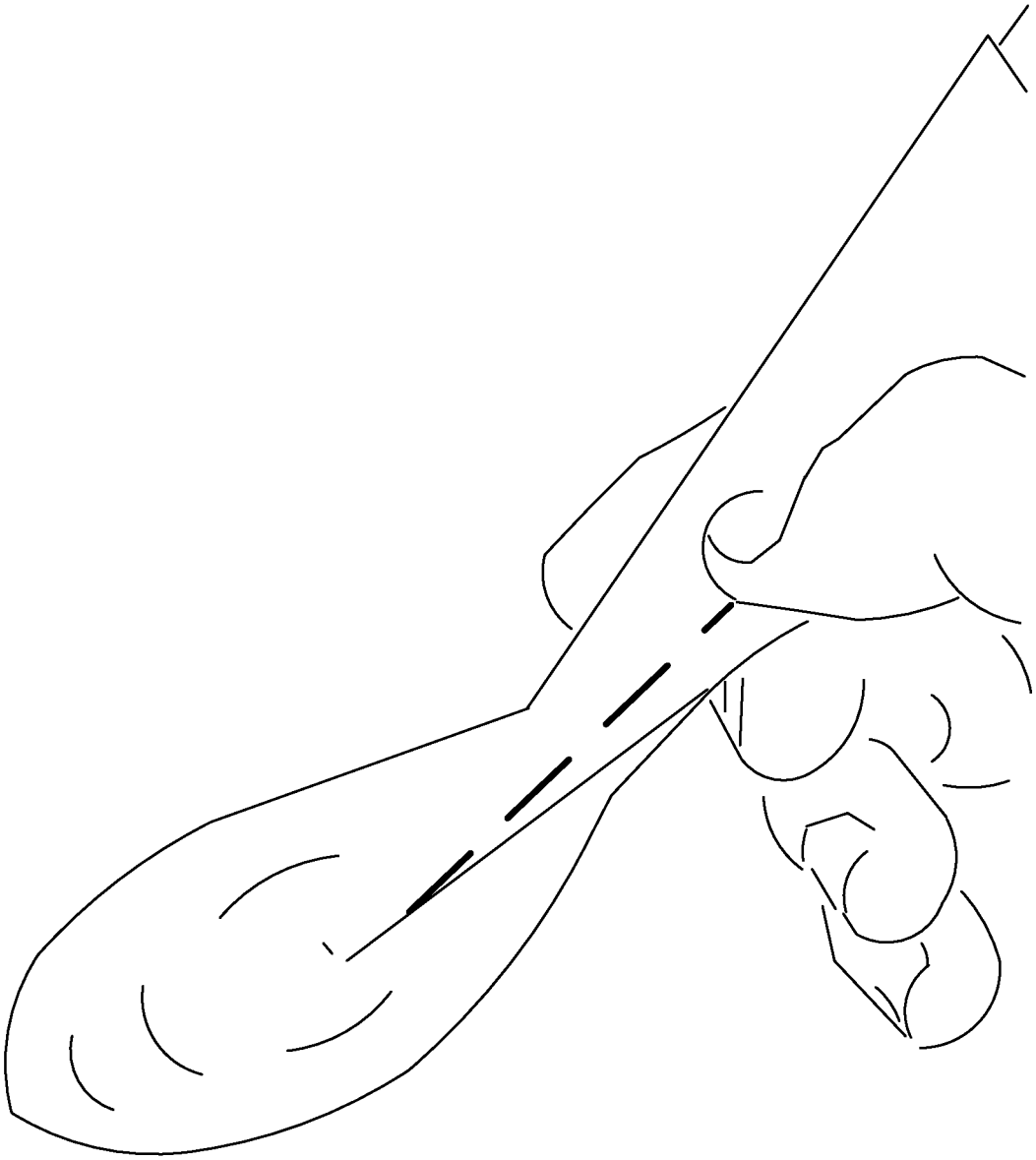
Figure 15:
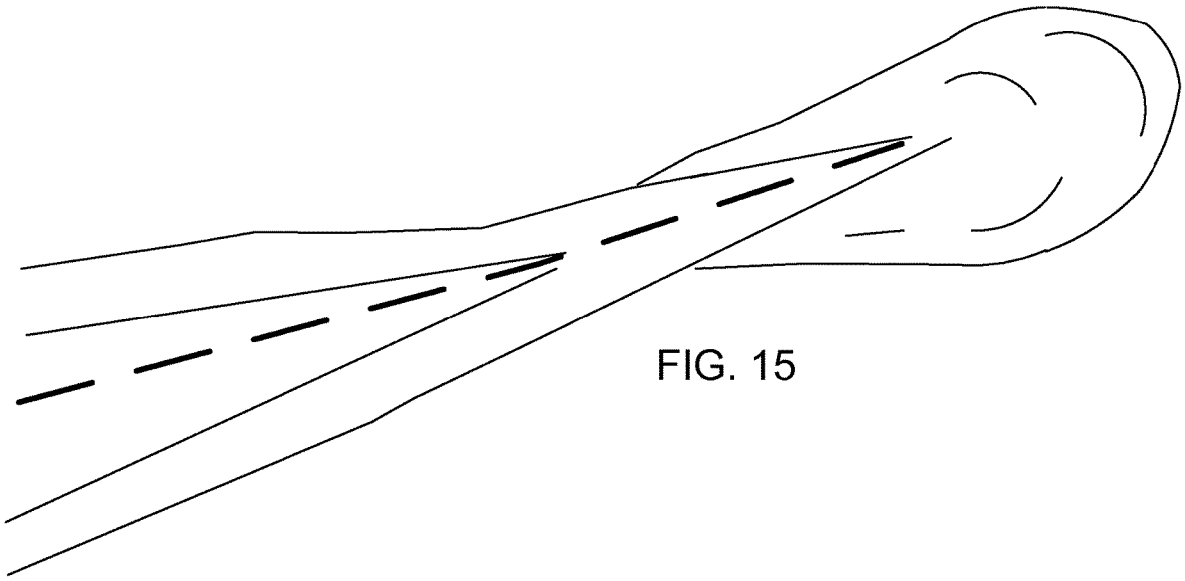

FIGS. 8-10 illustrate the preferred method of folding. For demonstration purposes, the figures show that paper was utilized. However, other materials will work as well. For example, for eating thick, heavy, viscous foods (for example, thick ice cream) it is preferred to create the folding spoon from cardstock or paperboard.

FIGS. 8-10 show the basic folds utilized to create a preferred spoon. These folds can be modified as desired to create multiple variations of the basic design. As shown in FIG. 7, solid lines represent an apex and dotted lines represent valleys.

Figure 6:
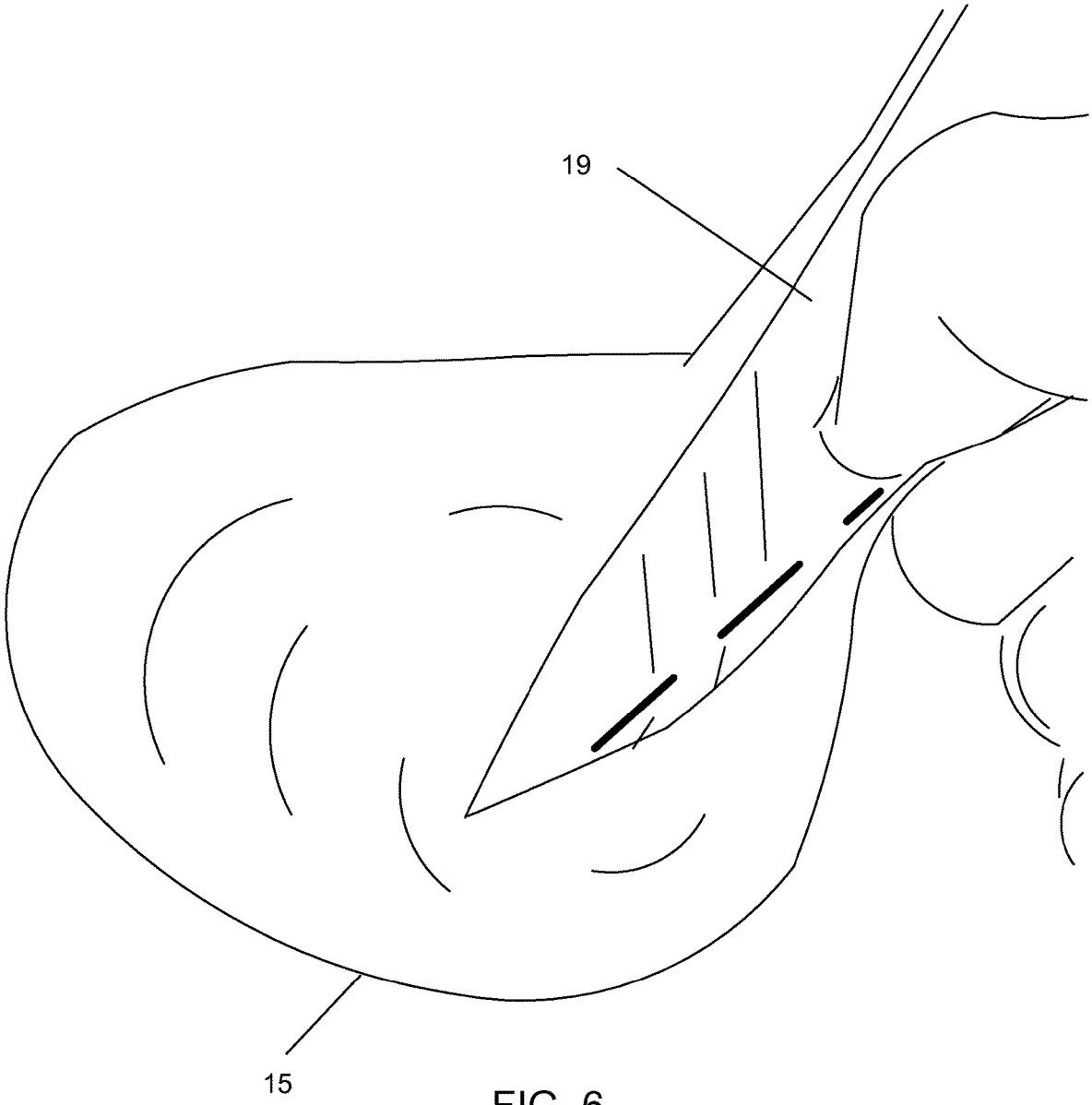
Figure 16:
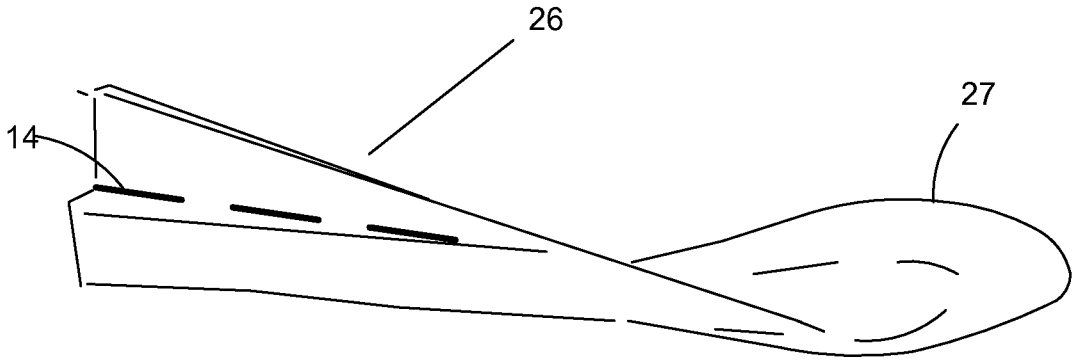
Figure 17:
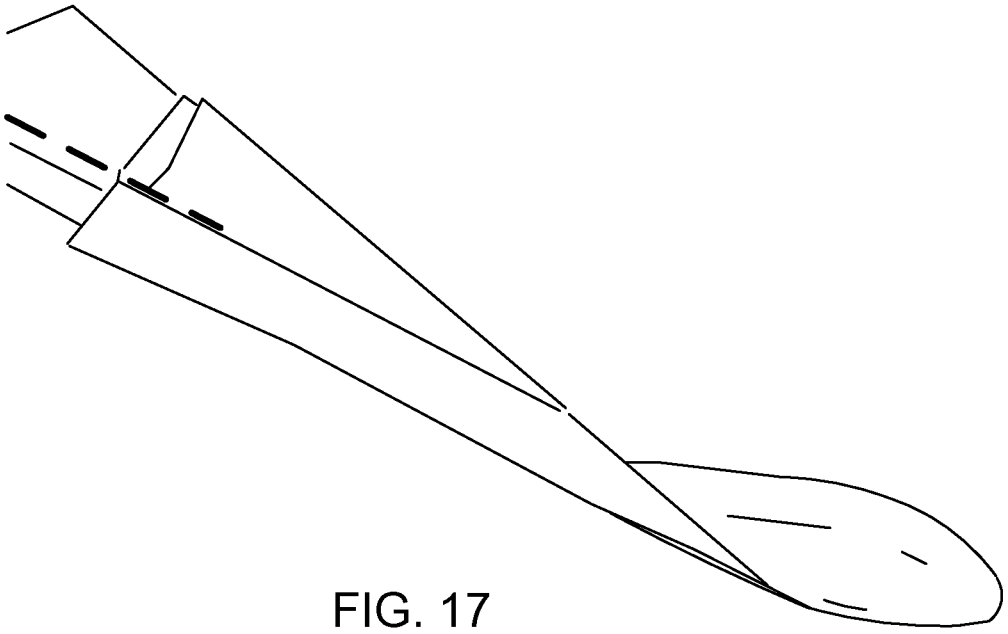
Figure 18:
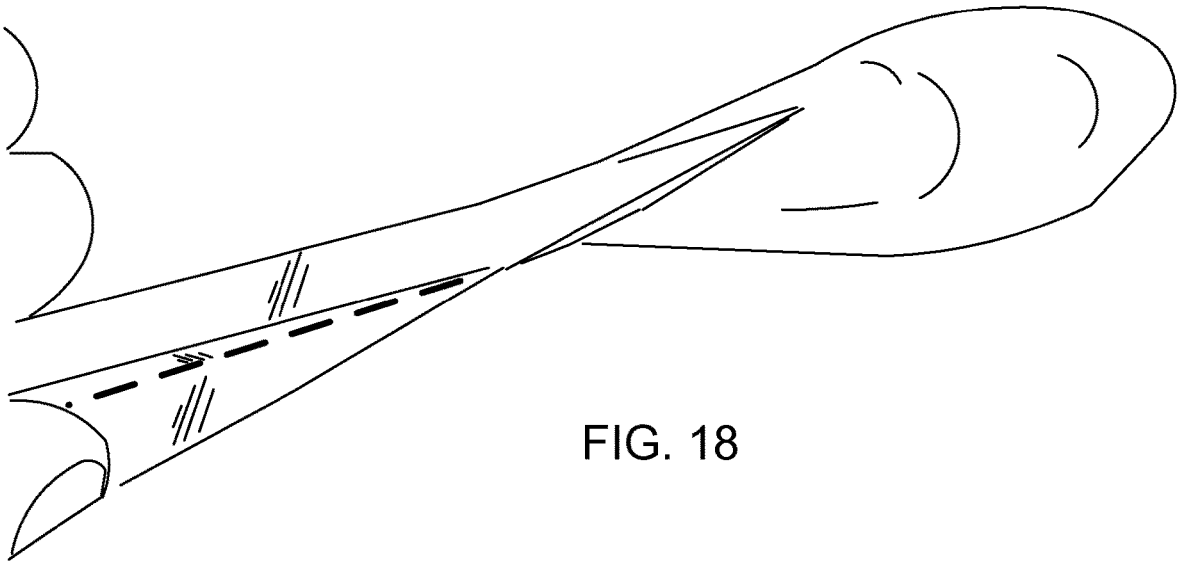
Figure 19:
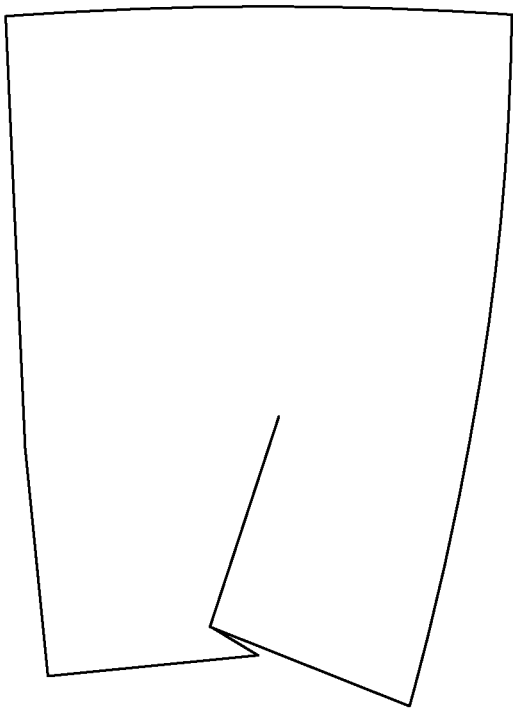
FIGS. 19-22 show another preferred embodiment of the present invention.
Figure 19B:
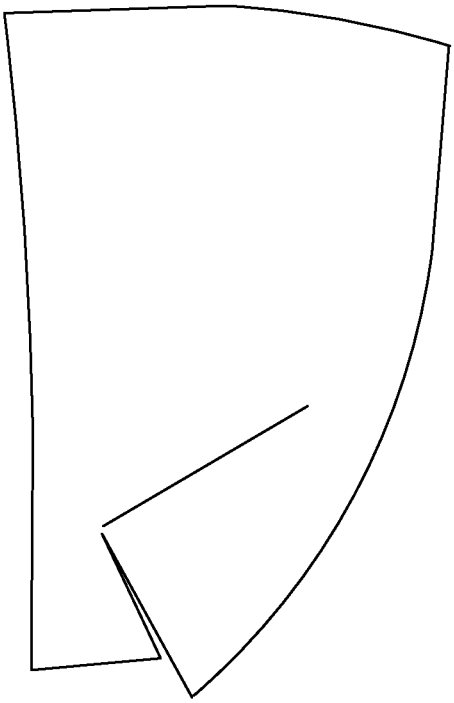
Figure 20:
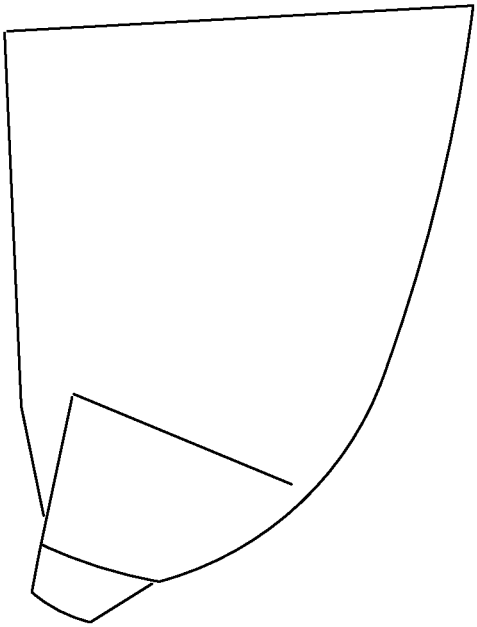
Figure 20B:
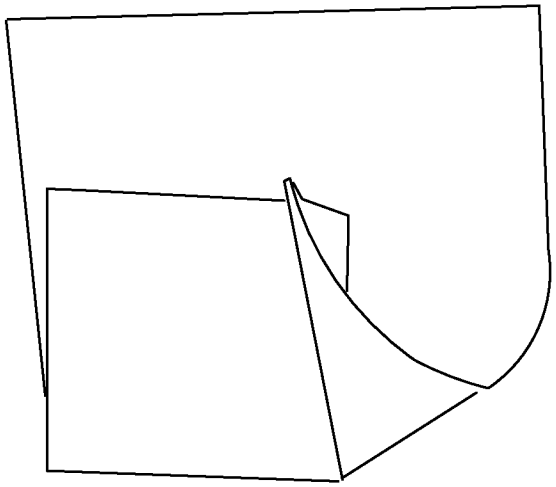
Figure 21A:
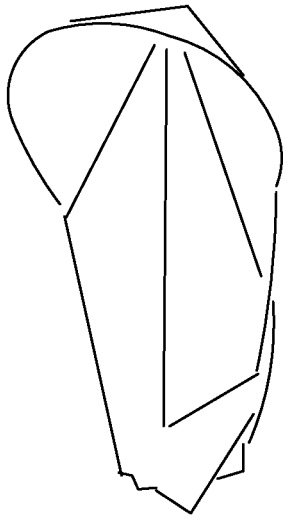
Figure 21B:
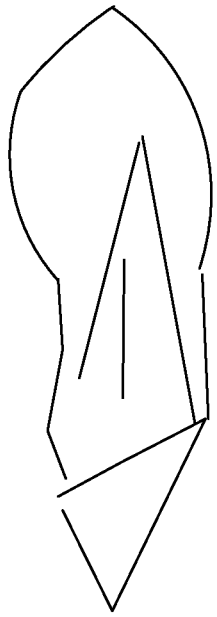
Figure 21C:
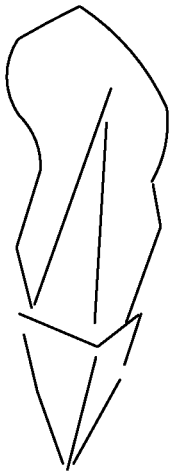
Figure 21D:
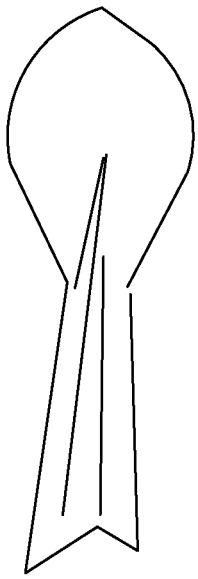
Figure 22A:
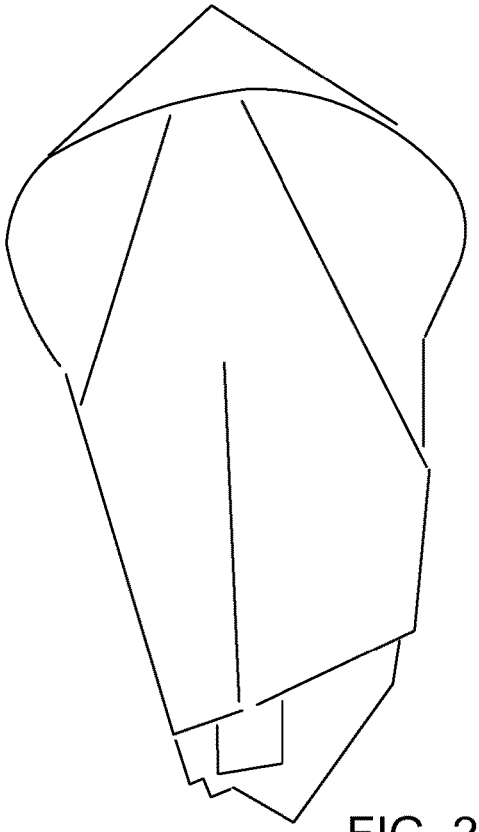
Figure 22B:
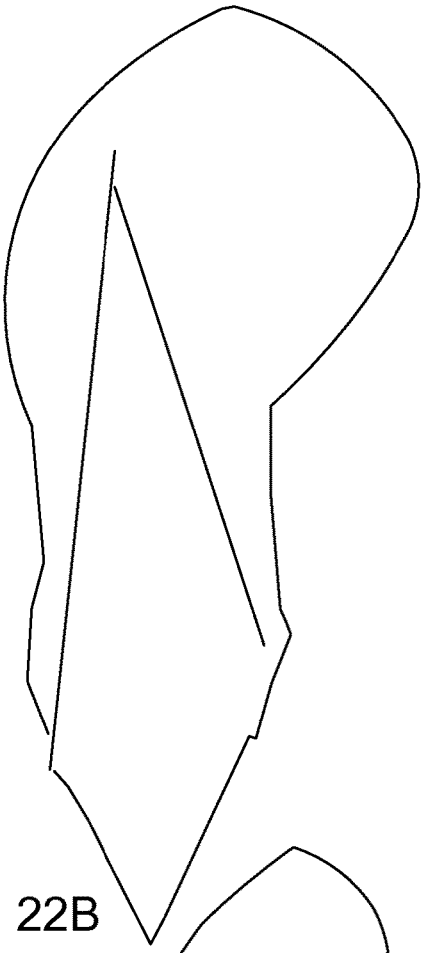
Figure 22C:
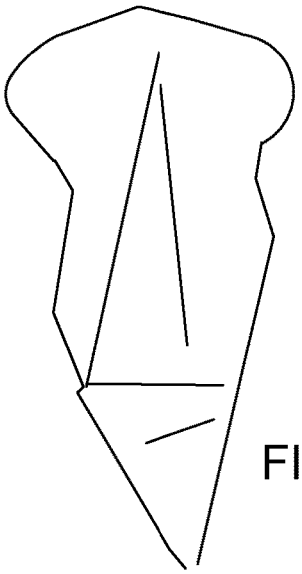
Figure 22D:
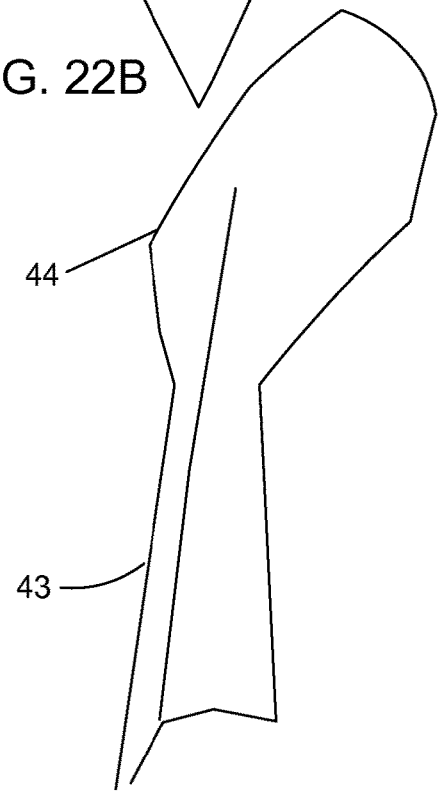

For example, FIGS. 1-6 show a first preferred embodiment of a folding spoon. From a single sheet of paper apex folds 13 and valley folds 14 are folded onto each other to create a strong, rigid handle 19 (FIG. 6). Cup portion 15 is used for scooping and holding the food. As shown in the figures, a user can create his spoon by following the steps clearly shown. FIGS. 11-18 show the steps for creating another preferred spoon having handle 26 and cup portion 27 (FIG. 16). FIGS. 19-20B show a preferred method for folding a sheet of paper. FIGS. 21A-22D show multiple spoons using the preferred folding method disclosed herein.

Figure 23:
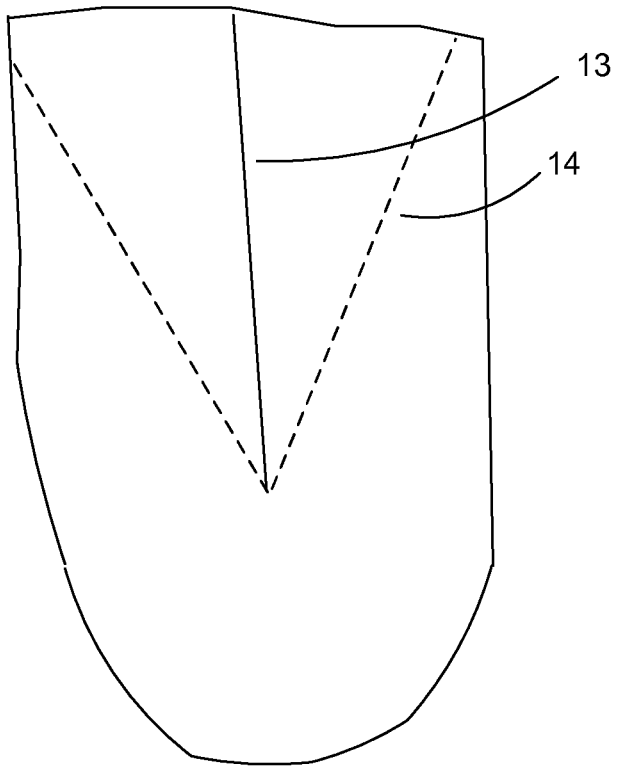
FIGS. 23-24 show another preferred embodiment of the present invention.
Figure 24:
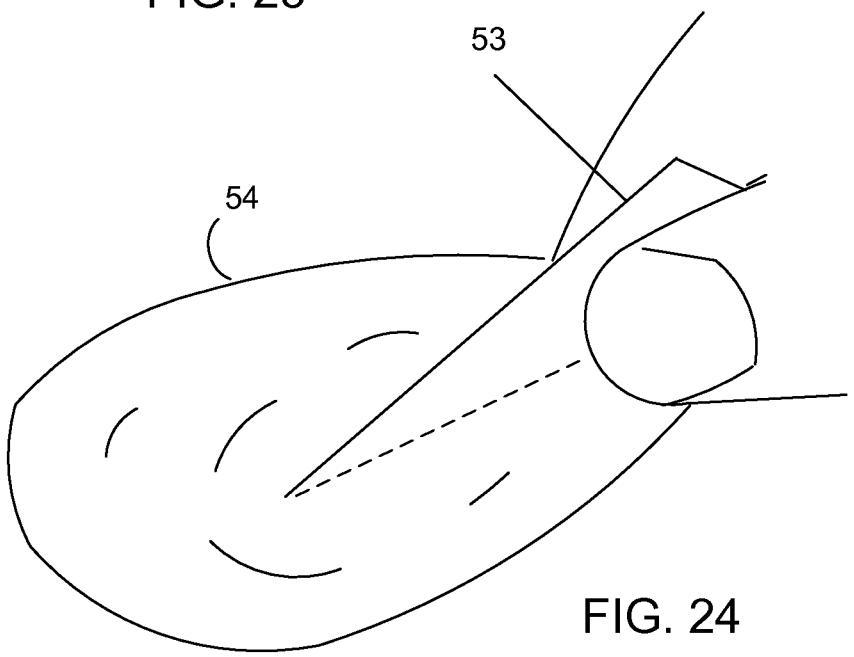
Figure 25:
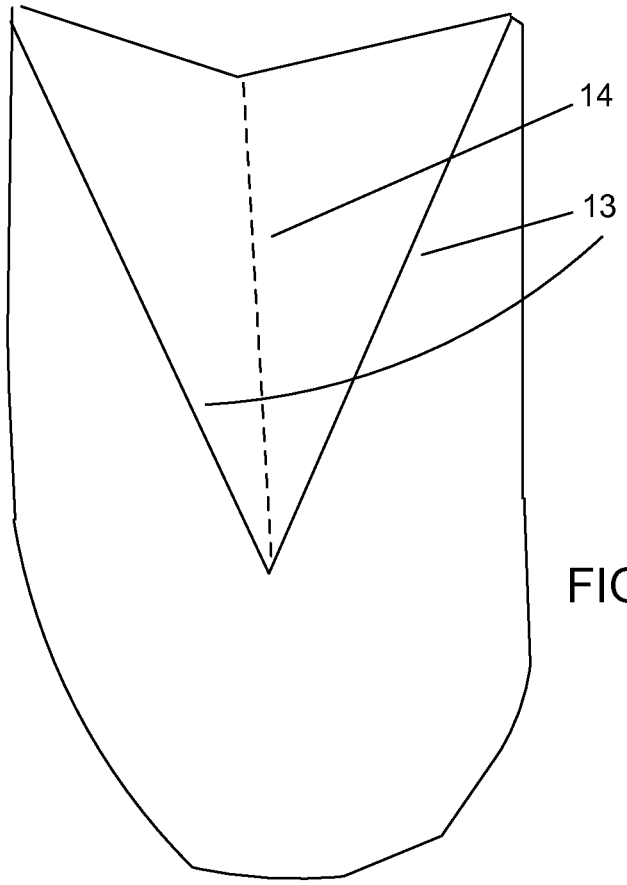
FIGS. 25-26 show another preferred embodiment of the present invention.
Figure 26:
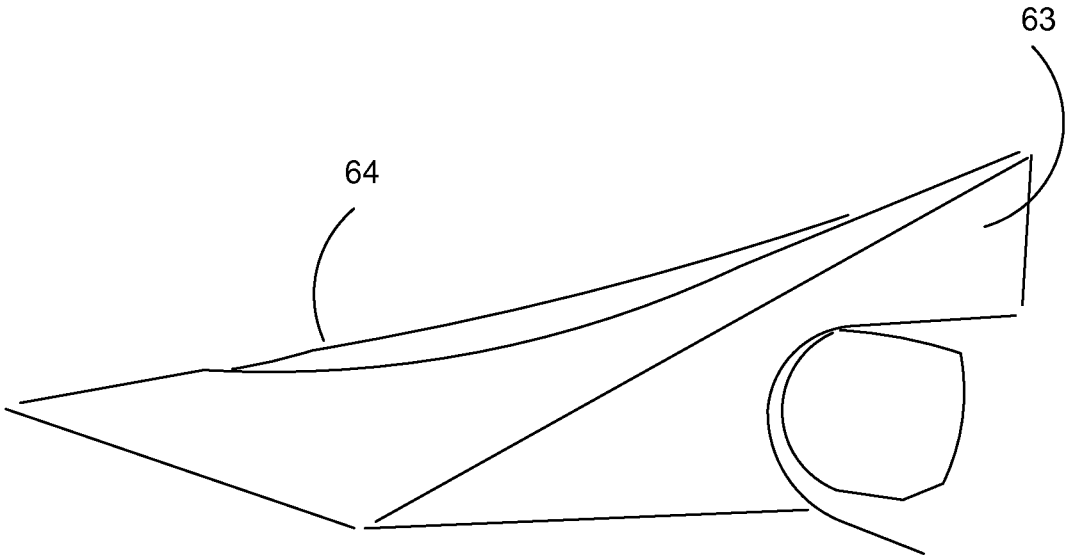
Figure 27:
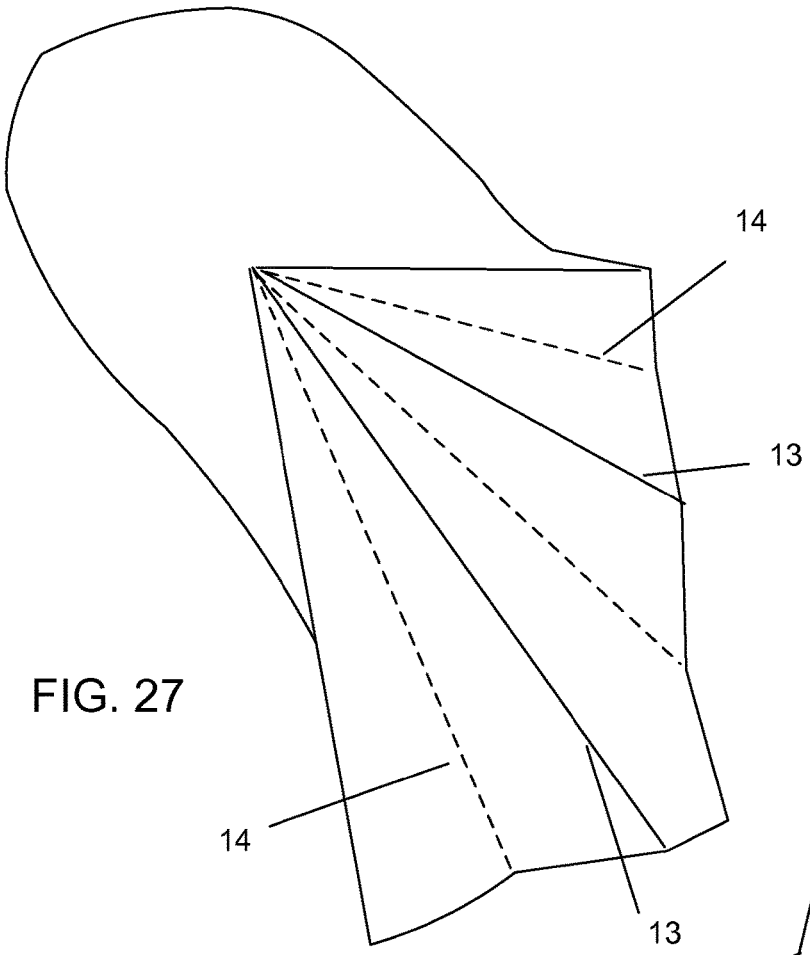
FIGS. 27-28 show another preferred embodiment of the present invention.
Figure 28:
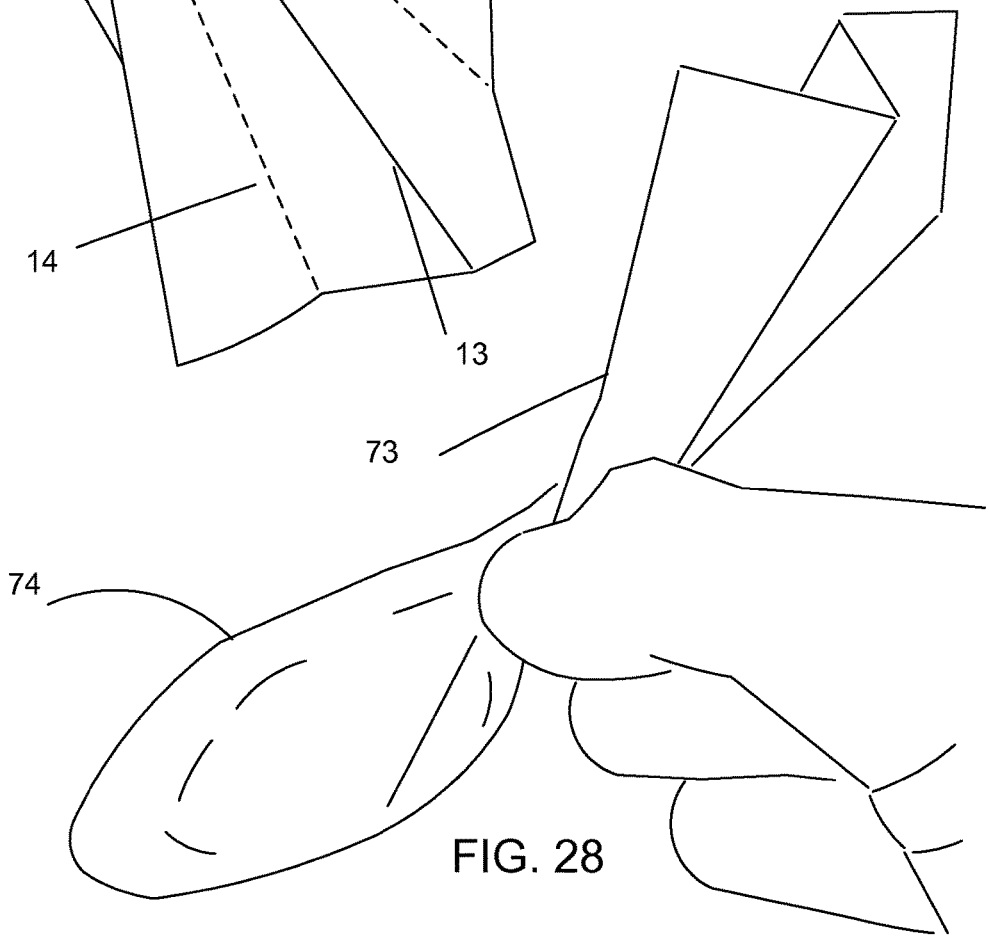
Figure 29:
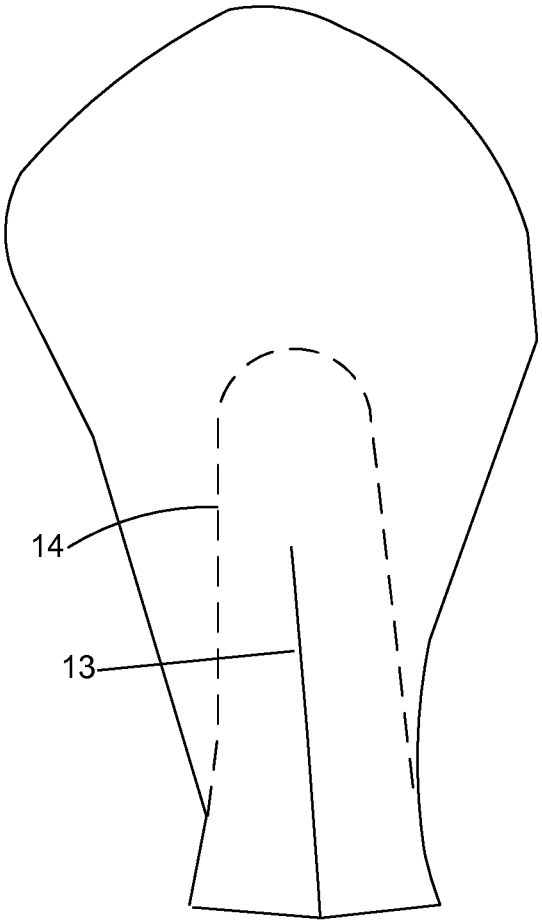
FIGS. 29-31 show another preferred embodiment of the present invention.
Figure 30:
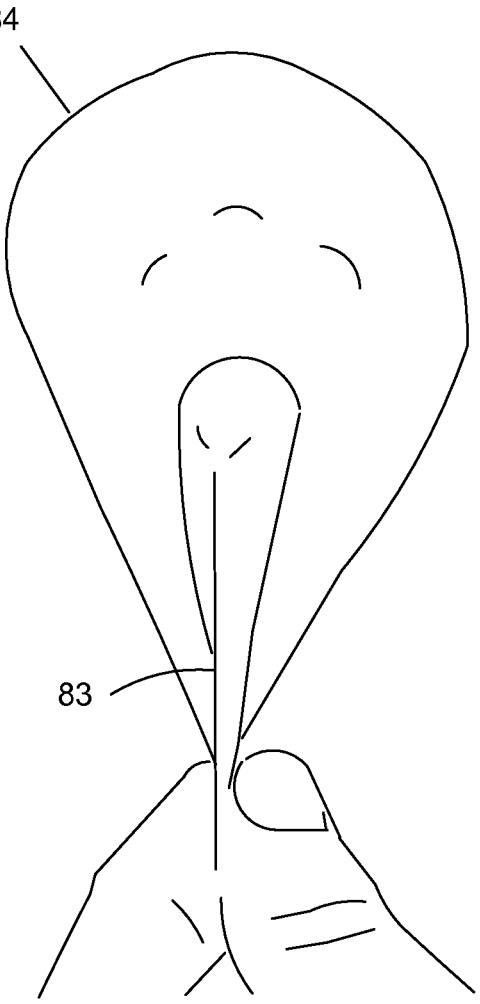
Figure 31:
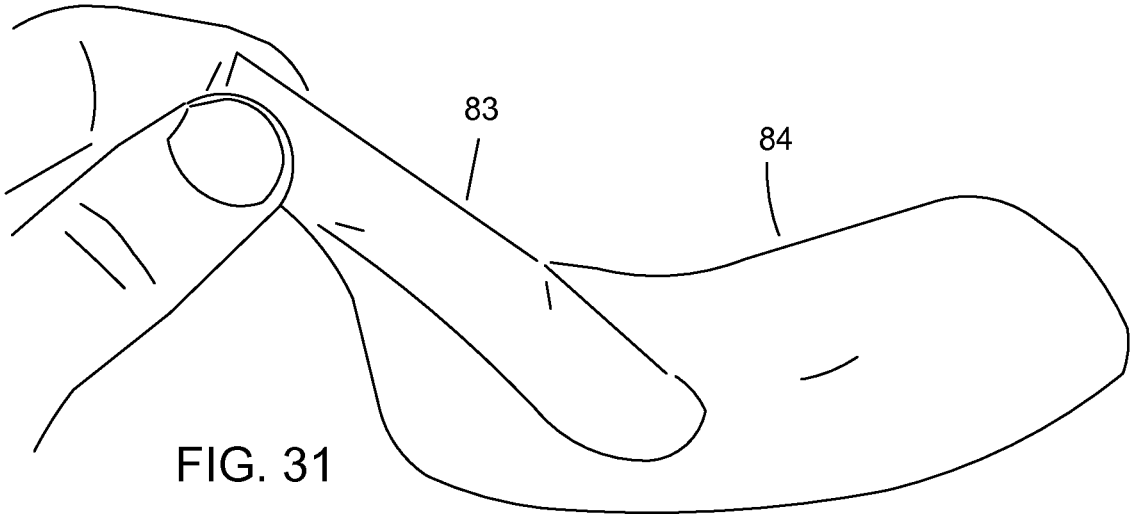
Figure 32:
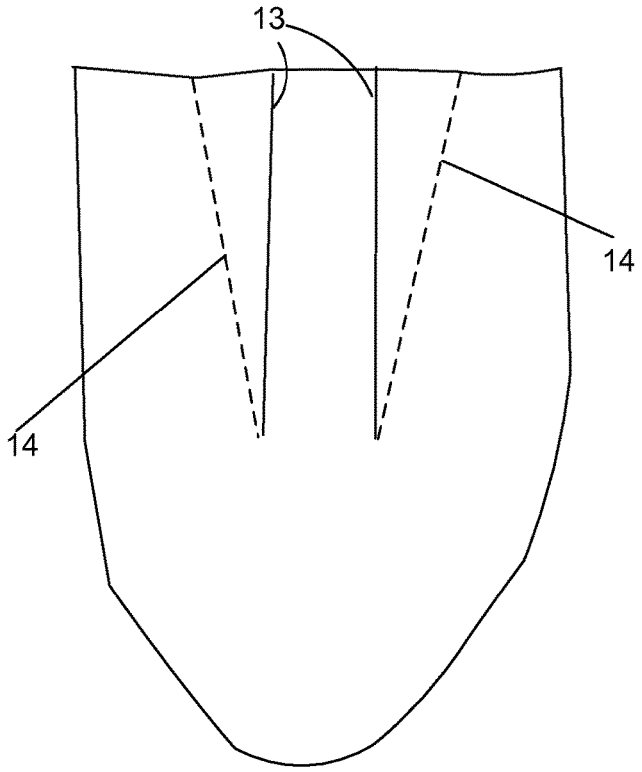
FIGS. 32-34 show another preferred embodiment of the present invention.
Figure 33:
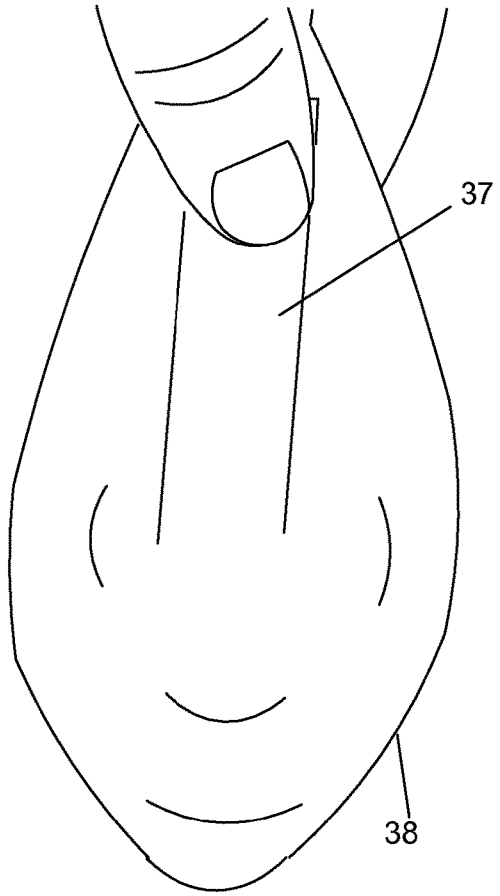
Figure 34:
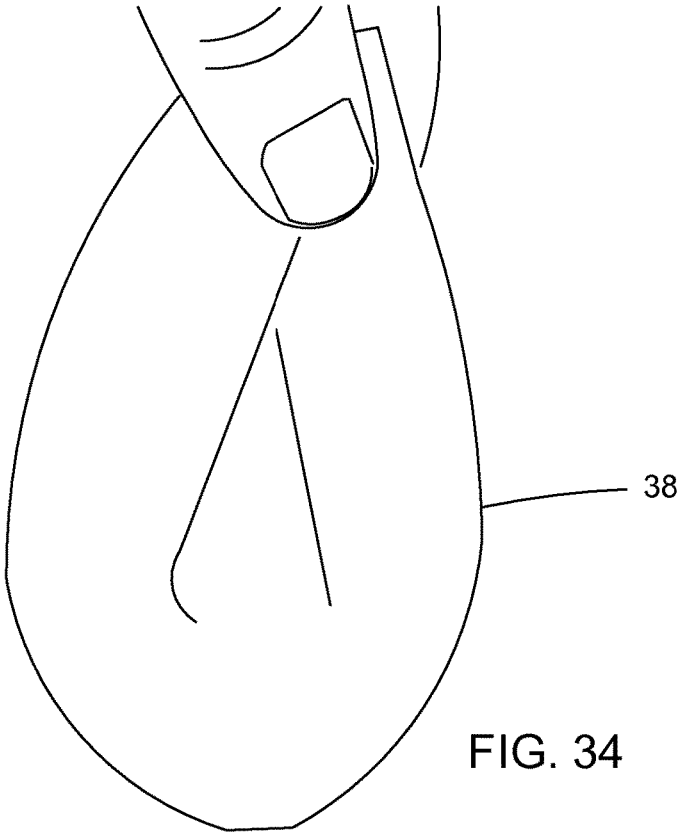
Figure 42:
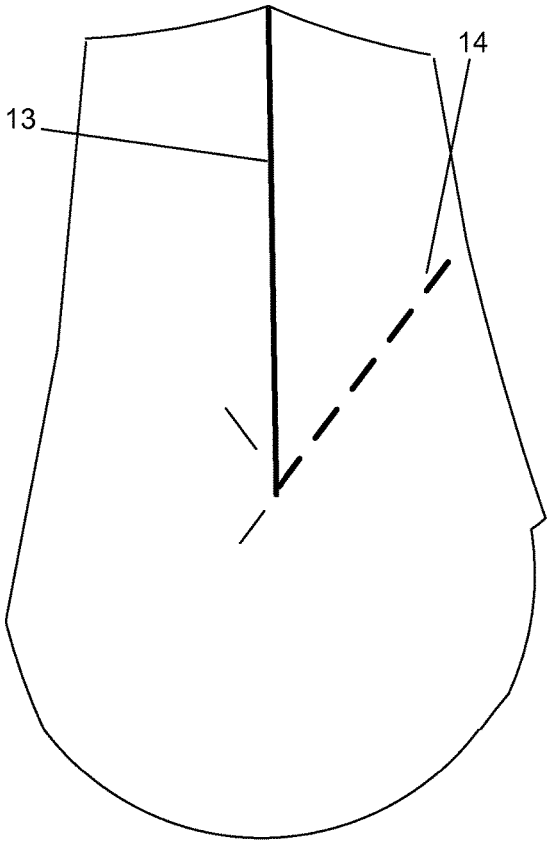
FIGS. 42-44 show another preferred embodiment of the present invention.
Figure 43:
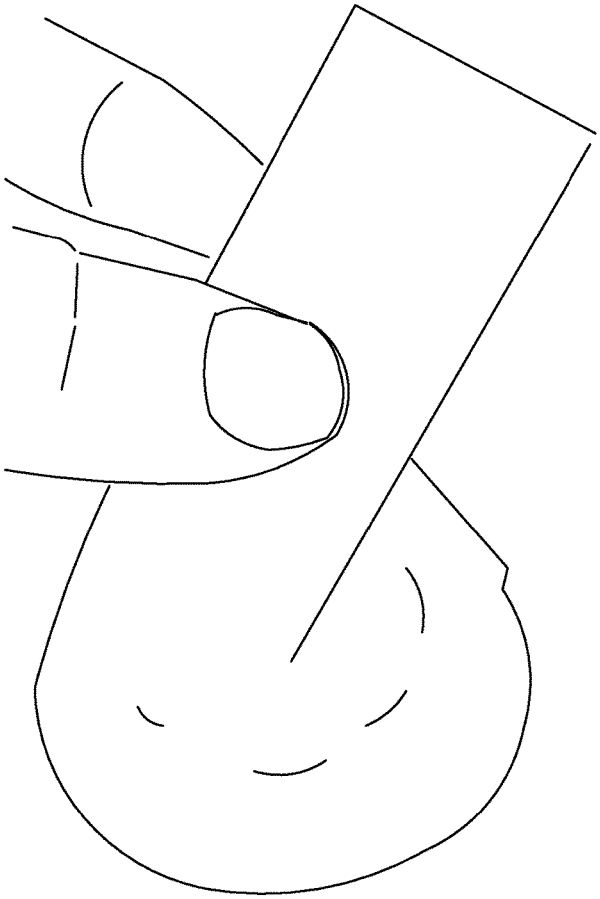
Figure 44:
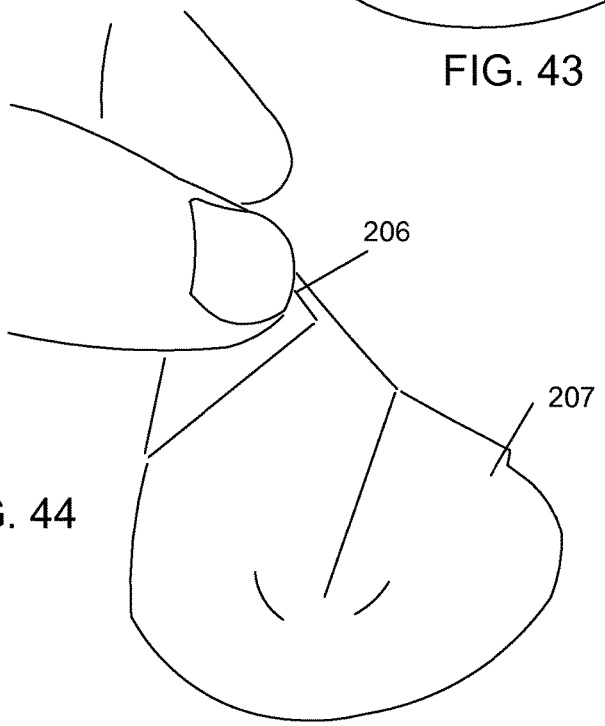
Figure 45:
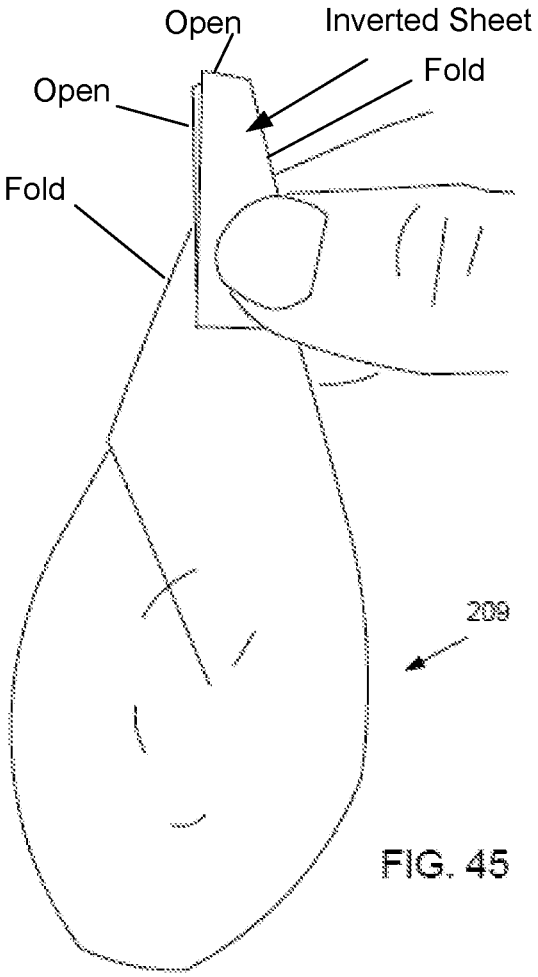
FIG. 45 shows another preferred embodiment of the present invention.
Figure 46:
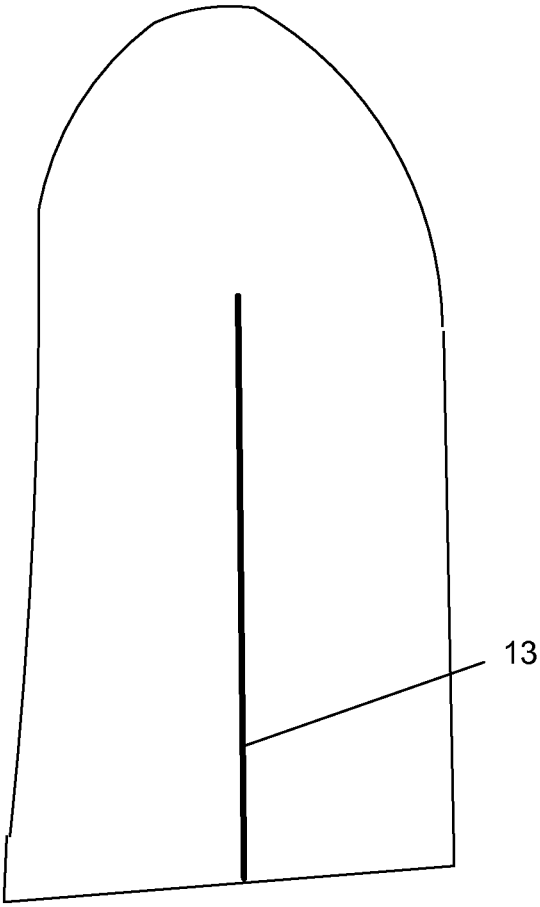
FIGS. 46-47 shows another preferred embodiment of the present invention.
Figure 47:
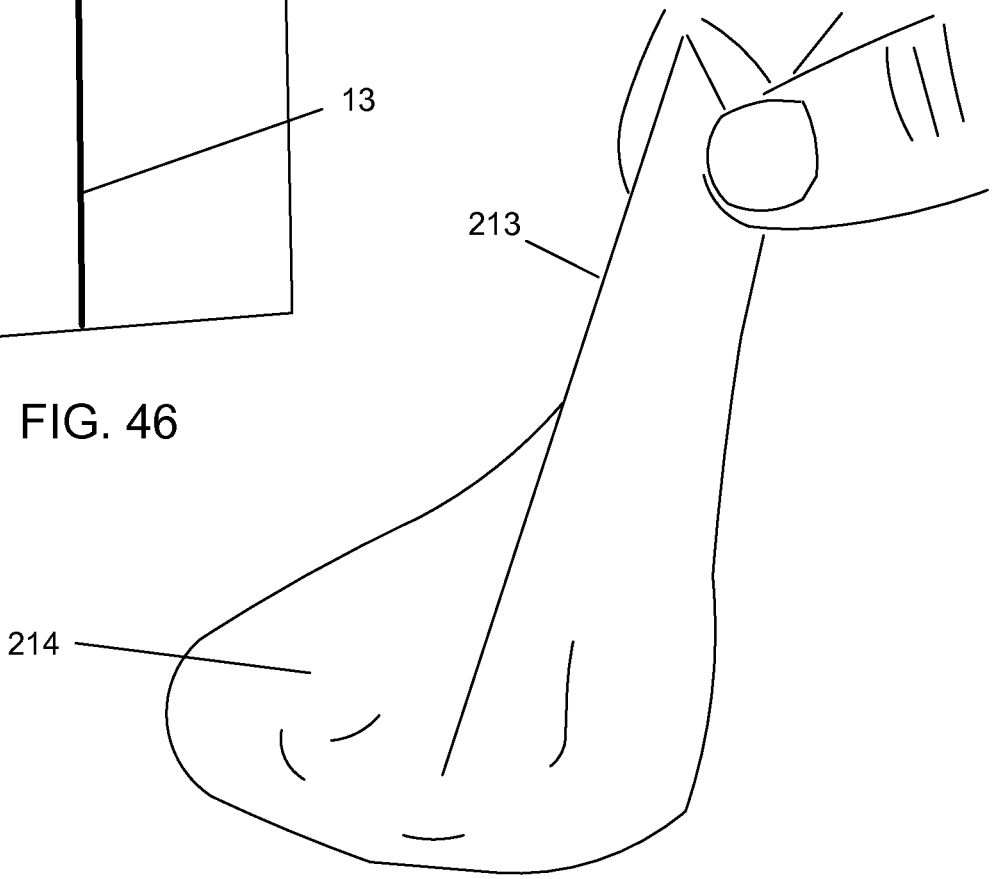

FIG. 23 shows folds 13 and 14 for a very simple spoon (FIG. 24) having handle 53 and cup portion 54. FIG. 25 shows folds 13 and 14 for another very simple spoon (FIG. 26) having handle 63 and cup portion 64. FIG. 27 shows folds 13 and 14 for a very simple spoon (FIG. 28) having handle 73 and cup portion 74. FIG. 29 shows folds 13 and 14 for another very simple spoon (FIGS. 30-31) having handle 83 and cup portion 84. FIG. 32 shows folds 13 and 14 for a very simple spoon (FIGS. 33-34) having handle 37 and cup portion 38. FIG. 33 shows the top view of the spoon. FIG. 33 shows the top view of the spoon. FIG. 34 shows the bottom view of the spoon. FIG. 34 shows the bottom view of the spoon. FIGS. 39 and 40 show fold 13 for a spoon (FIG. 41) having handle 203 and cup portion 204. FIG. 42 shows folds 13 and 14 for a spoon (FIGS. 43-44) having handle 206 and cup portion 207. FIG. 45 shows preferred spoon 209. FIG. 46 shows fold 13 for a spoon (FIG. 47) having handle 213 and cup portion 214.

Preferred Usage Types

In a preferred embodiment of the present invention, a folding spoon is sold along with purchased food. In one preferred embodiment, the user purchases a single serving of ice cream a pint or half-pint container (FIGS. 35-38). Paper (i.e., cardboard, paperboard or cardstock) is included with the purchase. Preferably, the paper includes folds, creases, dotted lines, and solid lines to serve as a guide to the purchaser on how to fold a spoon. The purchaser is then able to easily fold the paper and create the spoon. In a preferred embodiment, instructions are also included as a guide to the purchaser.

Figure 35:
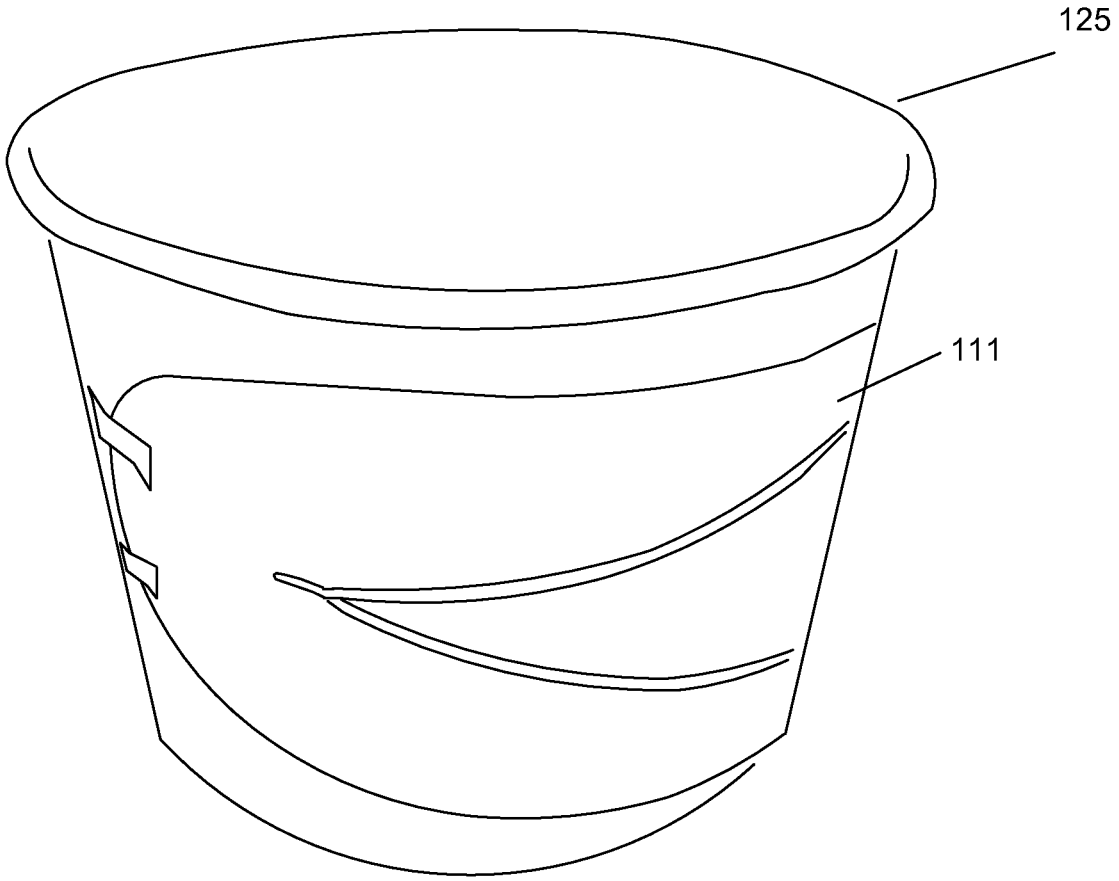
FIGS. 35-37 show alternate methods for attaching a preferred unfolded spoon to a preferred ice cream container.
Figure 36:
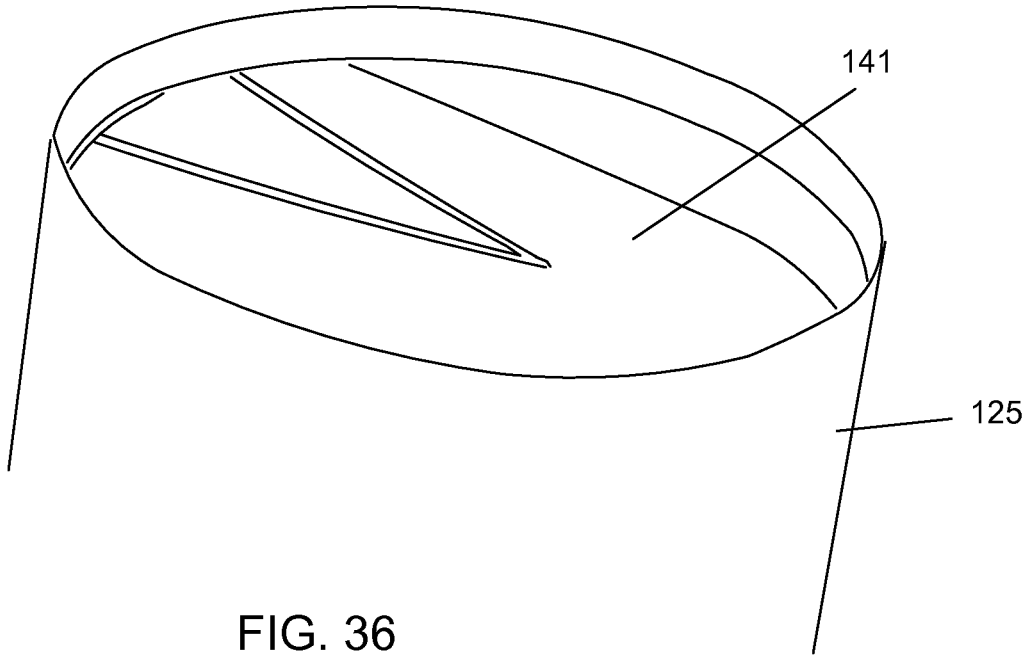

For example, FIG. 35 shows an unfolded spoon 111 taped to the side of ice cream container 125. FIG. 36 shows unfolded spoon 141 press fit into the bottom of ice cream container 125.

Figure 37:
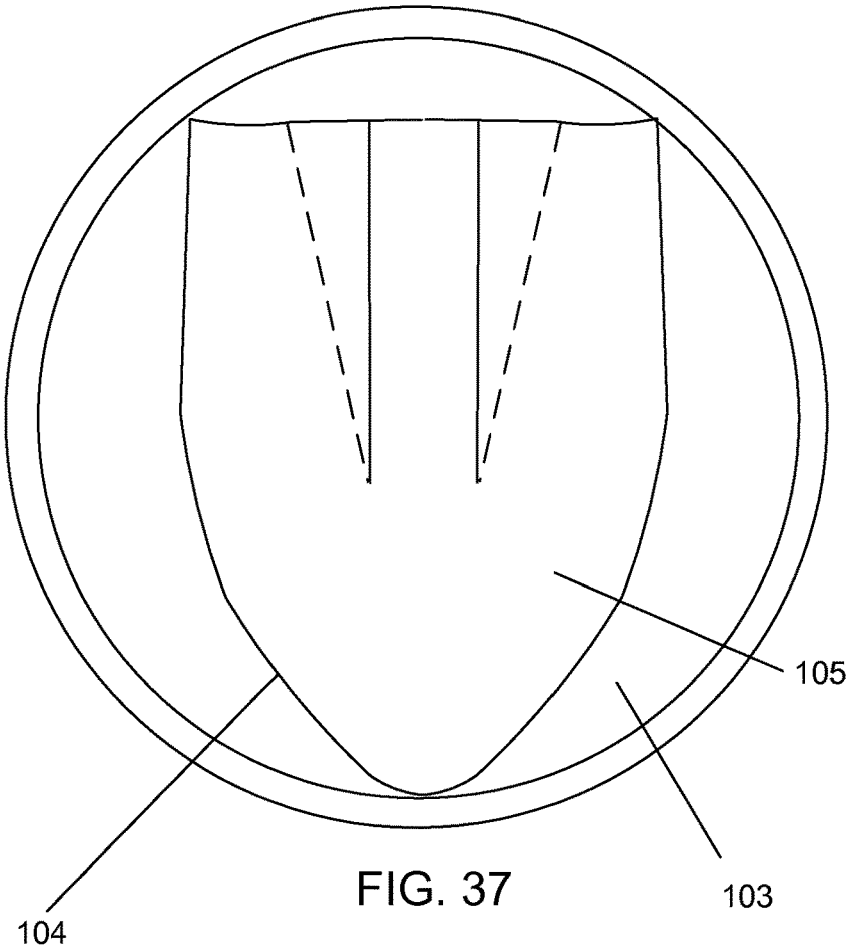
Figure 38:
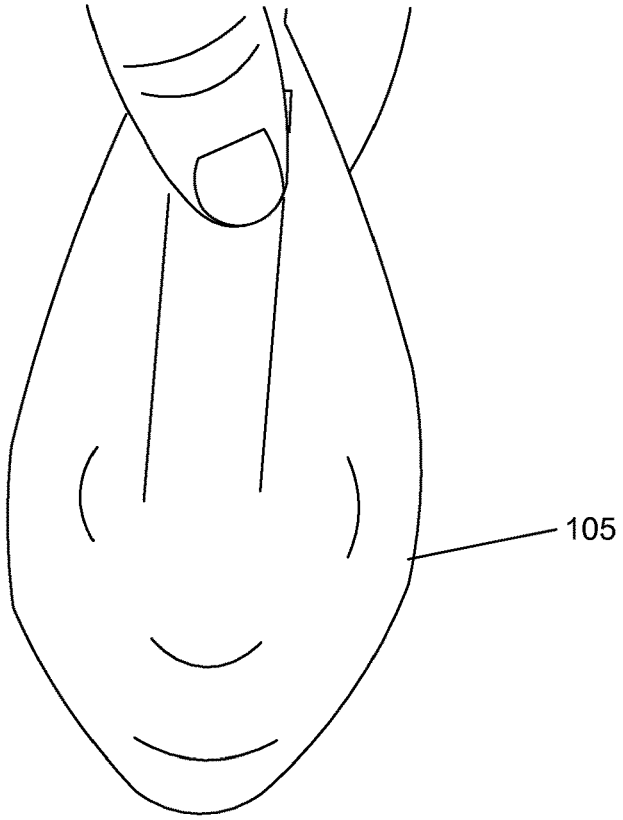
FIG. 38 shows another preferred embodiment of the present invention.

In another preferred embodiment, the single servicing ice cream container includes a lid 103 (FIG. 37). The lid preferably includes perforations, pre-folds, dotted lines, and solid lines to assist to consumer in creating his spoon. For example, outside edge 104 is perforated so that a purchaser of the ice cream container can easily punch out spoon 105 (unfolded) after removing lid 103 from the top of the ice cream container. The user can then easily fold the unfolded spoon to form folded spoon 105, as shown in FIG. 38.

Other Materials

Figure 48:
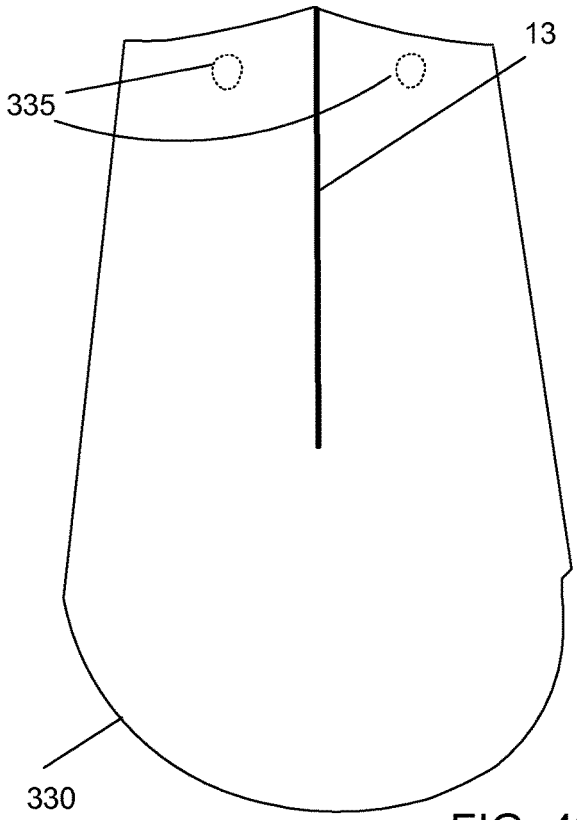
FIGS. 48-51 show another preferred embodiment of the present invention.
Figure 49:
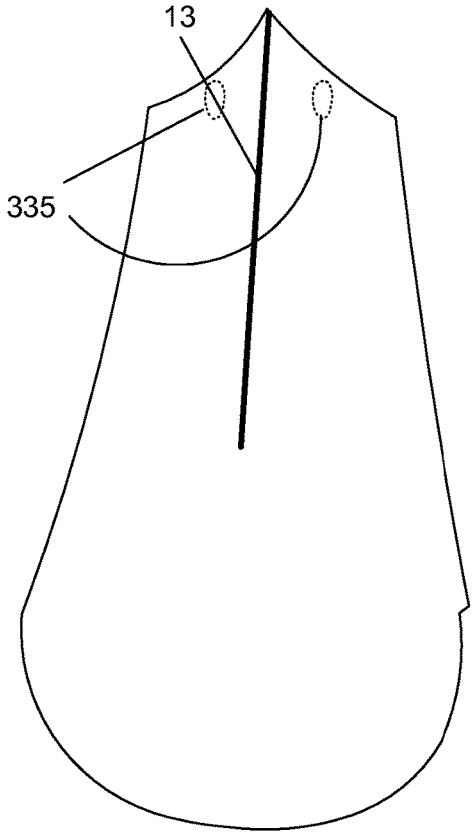
Figure 51:
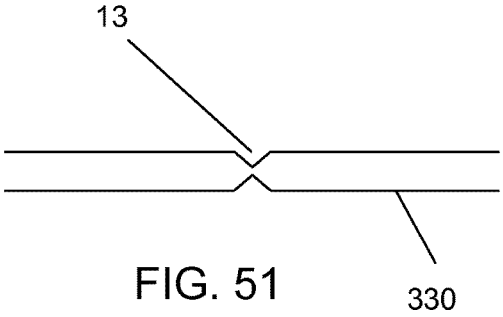
Figure 50:
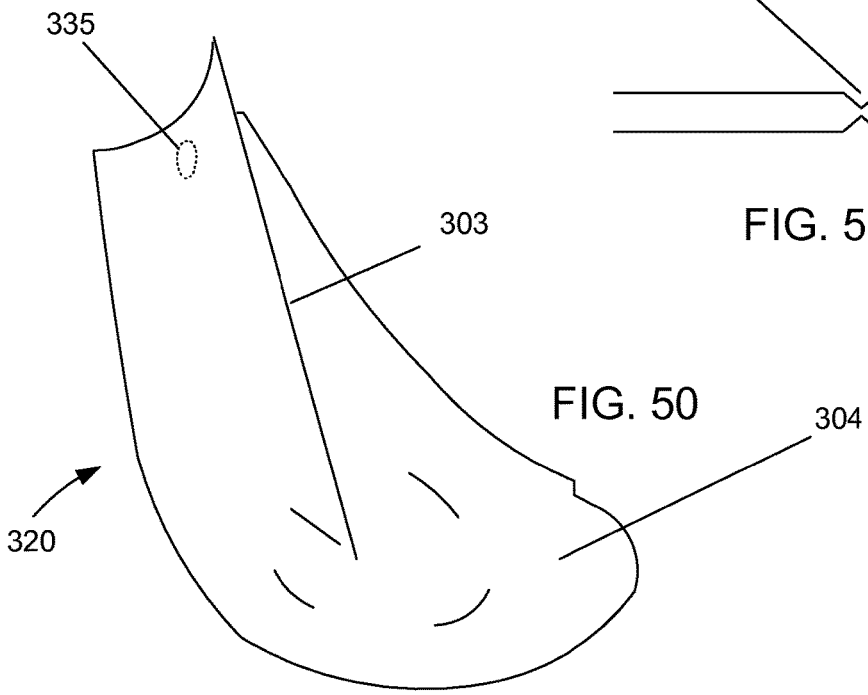

In other preferred embodiments it is possible to modify the material of the foldable spoon. For example, FIGS. 48-51 show a silicon sheet 330 that has been injection molded, as shown. As shown best in FIG. 51, sheet 330 is relatively thick to give it greater strength. The thickness decreases at fold 13 to make sheet 330 easier to fold. FIGS. 48-49 show sheet 330 in the process of being folded into spatula 320 having handle 303 and cup portion 304 (FIG. 50). Sheet 330 includes binding devices 335. Binding devices 335 function to hold sheet 330 in place after it has been folded. In one preferred embodiment binding devices 335 are magnets. In other preferred embodiments, binding devices 335 are snaps. Likewise, binding mechanisms 335 can be a hook and loop fastener (i.e., VELCRO®), a plastic clip or even duct tape. In a preferred embodiment, binding devices 335 are embedded into sheet 330 during the injection molding process.

It is advantageous to use strong, heat resistant materials such as silicon silicone to make bendable spoons as shown in FIGS. 48-51. The bendable spoon shown in FIGS. 48-51 can be used in high temperature situations, such as a spatula while frying food or as a soup spoon for cooking soup or chili.

Although the above-preferred embodiments have been described with specificity, persons skilled in this art will recognize that many changes to the specific embodiments disclosed above could be made without departing from the spirit of the invention. For example, in the above disclosure, examples were given of methods of folding spoons. It should be understood that the word "spoons" is understood to be used to refer to any object or utensil that is capable of scooping or moving a liquid or a solid, such as food or water. For example "spoons" is likewise understood to refer to such items as forks, knives, spatulas, scooping devices, shovels, snow shovels, hand shovels as well as many other similar devices. Also, the method of folding spoons described above can be applied to other utensils. For example, a variety of spoons, eating utensils, cooking utensils and scooping devices can be similarly created. Also, other materials can be utilized besides a sheet of paper. For example, sheets of plastic, sheets of metal and sheets of fiberglass can be utilized. It is even possible to fold types of food into spoons. For example, beef jerky can be easily folded into a spoon or spatula. Or a tortilla could be easily folded.

Furthermore, it should be understood that multiple sheets or sheets of various thicknesses could be utilized. For example, it would be possible to stack sheets (or laminate sheets) and then fold the sheets in utilizing the procedures described above. A stack of sheets and/or laminated sheets would add thickness and strength to the folded spoon. Other materials may also be utilized, such as injected silicone or molded rubber. Therefore, the attached claims and their legal equivalents should determine the scope of the invention

What is claimed is:

1. A foldable spoon formed from a sheet of foldable material, comprising,

A) a spoon handle, comprising a graspable section, no more than one apex fold at an apex point and no more than one valley fold meeting at said a apex point located on said sheet of foldable material, B) a spoon cup section connected to said spoon handle, wherein said sheet is bent backwards to form said spoon cup section, and wherein said cup section is capable of carrying food, and wherein said handle extends outward from said spoon cup section, wherein said handle is flat, and C) a first handle fold that forms a partially folded portion of said handle so that said partially folded portion extends only partially along the length of said handle, a second handle fold that forms a second partially folded portion of said handle so that said second partially folded portion extends only partially along the length of said handle thereby forming said graspable section of said spoon handle, wherein said partially folded portion of said handle comprises more than four layers of said sheet, wherein said more than four layers are each parallel to one another, wherein said no more than one apex fold, said no more than one valley fold, said first handle fold, said second handle fold and said spoon cup section are formed out of said sheet, wherein said graspable section of said spoon handle extends away from said cup section so that a user may grasp said graspable section without any fingers contacting said cup section.

* * * * *